US010889955B2

(12) United States Patent
Niermann et al.

(10) Patent No.: US 10,889,955 B2
(45) Date of Patent: Jan. 12, 2021

(54) CUTTING TOOL ADAPTER AND METHOD OF UNDERPINNING STRUCTURES USING CUTTING TOOL ADAPTER FOR SOIL MIXING

(71) Applicant: Schnabel Foundation Company, Sterling, VA (US)

(72) Inventors: Matthew J. Niermann, Ashburn, VA (US); Walter W. Trail, Jr., Hedgesville, WV (US)

(73) Assignee: Schnabel Foundation Company, Sterling, VA (US)

( * ) Notice: Subject to any disclaimer, the term of this patent is extended or adjusted under 35 U.S.C. 154(b) by 0 days.

(21) Appl. No.: 16/048,971

(22) Filed: Jul. 30, 2018

(65) Prior Publication Data

US 2020/0032477 A1 Jan. 30, 2020

(51) Int. Cl.

| | |
|---|---|
| ***E02D 27/48*** | (2006.01) |
| ***E02F 3/28*** | (2006.01) |
| ***E02D 37/00*** | (2006.01) |
| ***E02D 3/12*** | (2006.01) |
| ***E02D 7/00*** | (2006.01) |
| ***B01F 3/18*** | (2006.01) |

(Continued)

(52) U.S. Cl.

CPC ..... *E02D 27/48* (2013.01); *B01F 3/18* (2013.01); *B01F 13/0032* (2013.01); *B01F 13/1011* (2013.01); *B01F 13/1041* (2013.01); *E02D 3/126* (2013.01); *E02D 7/00* (2013.01); *E02D 37/00* (2013.01); *E02F 3/22* (2013.01); *B01F 2013/108* (2013.01); *E02D 2250/003* (2013.01); *E02D 2300/002* (2013.01); *E02D 2300/0004* (2013.01); *E02D 2300/0018* (2013.01); *E02D 2300/0021* (2013.01); *E02D 2300/0023* (2013.01)

(58) Field of Classification Search

CPC ..... E02D 27/48; E02D 37/00; B01F 13/0032
USPC ..... 405/230; 173/39
See application file for complete search history.

(56) References Cited

U.S. PATENT DOCUMENTS 3,786,641 A * 1/1974 Turzillo ..... E02D 27/48 405/230
4,106,225 A * 8/1978 Schnabel, Jr. ..... E02D 27/48 173/195

(Continued)

OTHER PUBLICATIONS

Project: Antraquip AQ4—John Deere 200—Railroad Tunnel Enlargement, downloaded from <http: antraquip.net/applications/tunneling/aq4-roadheader-john-deere-200-railroad-tunnel-enlargement/> on Feb. 13, 2020.

(Continued)

*Primary Examiner* — Tara Mayo-Pinnock
(74) *Attorney, Agent, or Firm* — Banner & Witcoff, Ltd.

(57) ABSTRACT

A cutting tool adapter for creating an underpinning structure and method of creating the underpinning structure are provided. In some examples, the cutting tool adapter may connect a cutting tool to a working machine arm to enable the cutting tool to cut and dislodge soil below an existing foundation or structure. As the soil is cut and dislodged, it is mechanical mixed with an additive, such as a cementitious material, via the cutting tool. The mixed soil and additive may then harden in the area below the existing structure or foundation to create an underpinning structure to provide additional support for the existing structure or foundation.

13 Claims, 21 Drawing Sheets

(51) Int. Cl.

| | |
|---|---|
| ***B01F 13/00*** | (2006.01) |
| ***B01F 13/10*** | (2006.01) |
| ***E02F 3/22*** | (2006.01) |

(56) References Cited

U.S. PATENT DOCUMENTS

| | | | | |
|---|---|---|---|---|
| 5,975,644 | A * | 11/1999 | Lang | A01G 23/067 144/24.12 |
| 6,193,444 | B1 | 2/2001 | Jonninen | |
| 2011/0188947 | A1* | 8/2011 | Biserna | E02D 3/126 405/268 |
| 2016/0097177 | A1* | 4/2016 | Lebreton et al. | E02D 5/34 405/237 |

OTHER PUBLICATIONS

"Quickcoupler for compact excavators", Lehnhoff Hartstahl, 1st Edition, Aug. 20, 2016, downloaded from <www.lehnhoff.com/downloads-en.html>, product brochure on website, LH_Schnellwechsler_6-12t_2019_EN_mail.pdf.

* cited by examiner

SECTION A-A

SECTION B-B

CUTTING TOOL ADAPTER AND METHOD OF UNDERPINNING STRUCTURES USING CUTTING TOOL ADAPTER FOR SOIL MIXING

TECHNICAL FIELD

Aspects described herein relate to foundation support of existing structures via the use of soil-cement underpinning elements and structures. In particular, aspects are directed to a cutting tool adapter configured to enable soil-cement mixing below an existing structure and methods of performing soil-cement mixing and installation of soil-cement underpinning structures.

BACKGROUND

Foundation underpinning is a technology used for strengthening a foundation of an existing structure by extending the foundation of the existing structure to a deeper elevation. Foundation underpinning is often used in situations where the existing foundation is no longer strong enough to support the structure, properties of the soil around the structure have changed, additional structures are being constructed adjacent to or nearby the existing structure, additional load bearing capacity is desired, and the like. There are several methods of foundation underpinning.

For instance, concrete pit underpinning consists of hand and/or machine excavated pits or shafts that are filled with concrete. The concrete shafts are placed beneath an existing foundation. A conventional underpinning concrete shaft is a continuous block of concrete that extends from a bottom of a foundation of an existing structure to a suitable bearing stratum.

In some examples, an approach pit is first excavated in front of an underpinning shaft location. Next, the excavation is advanced laterally beneath the existing foundation a sufficient distance to provide suitable support to the foundation. Once the back side of the underpinning pit is reached, the excavation is then advanced vertically to a suitable bearing stratum. Throughout this process, shoring boards are positioned around the perimeter of the excavation to support the soil and prevent collapse. Additionally, shoring boards may also be positioned beneath the foundation to form a roof over the underpinning pit and prevent loose pieces of the existing foundation from falling into the pit below. Once excavation is complete, a temporary bulkhead is formed to separate the approach pit from the underpinning pit, and the underpinning pit is filled with concrete. The surface of the concrete is left approximately 3 inches below the bottom of the foundation so that a moistened sand-cement mixture may be packed into this void to ensure contact between the underpinning shaft and the foundation. If lateral support of the underpinning shaft is required, sub-horizontal tieback anchors or bracing may be installed during subsequent excavation in from of the underpinning shaft.

However, conventional concrete shaft underpinning has many shortcomings. For instance, conventional concrete shaft underpinning is expensive and can be dangerous work. For instance, although machines can be used in some instances, the majority of the work is performed manually (e.g., soil beneath an existing foundation is generally dug out by hand). The workers must enter a confined space subject to the accumulation of noxious gas at depth. Workers must also be equipped with appropriate fall protection when working next to open pits greater than 6 feet in depth.

Existing foundations may be in poor condition and may consist of rubble or stones that are not sufficiently mortared together to prevent collapse when undermined to the extent required for a hand-dug pit. This creates a hazardous condition for the workers and can be detrimental to the integrity of the structure being underpinned. Conventional concrete shaft underpinnings can be difficult to install through ground that is too dense and difficult to excavate or through ground that is too loose and prone to collapse before shoring boards can be positioned. Conventional concrete shaft underpinnings may also be difficult to install in ground that is below the water table.

One example alternative to conventional concrete shaft underpinning is jet grout underpinning. Jet grout underpinning or jet grouting utilizes a high-pressure pump to inject cement grout into the ground through one or more nozzles located on the sides of drill rods. The cement grout exits the nozzles at a high velocity and erodes the soil surrounding the drill rods. As the rods are slowly rotated and lifted, the cement grout erodes and mixes with the soil and forms a generally cylindrical soil-cement element (although other shapes are possible). Excess soil-cement (spoil) travels to the surface via the annulus around the drill rod created by an over-sized drill bit. Jet grouting may be effective in many soil types and may be installed through a small diameter drill rod (generally 3.5 in. to 5.5 in. diameter), which enables the soil-cement element to be installed partially beneath existing foundations. The high velocity fluid grout scours the surface of foundation surfaces located within the range of the jet and creates contact with the soil-cement. Additionally, the fluid soil-cement exerts hydrostatic pressure against the soil along the side and bottom surfaces of the soil-cement element, thereby stabilizing the adjacent soil and preventing collapse into the fluidified zone. The resulting soil-cement develops compressive strengths typically in the range of 50 to 2,000 psi. These strengths enable the soil-cement element to transfer foundation loads to a suitable bearing stratum.

Although soil-cement columns created by jet grouting exhibit good performance and may be used in-lieu of conventional concrete shaft underpinning, the jet grouting method has disadvantages. Jet grouting requires expensive specialized equipment, including high pressure pumps and rotary drill rigs. It also requires specialized tooling, including high efficiency carbide nozzles and high-pressure swivels. Jet grouting relies on the erosive action of the high velocity grout stream, and therefore, its effectiveness is diminished in difficult to erode soils such as stiff clays and cemented sands. It is sometimes possible to drill through a foundation and install a circular jet grout column so that the column is wholly beneath a foundation, however, in most cases the center of the jet grout column must be located adjacent to the foundation. In this configuration, only a circular segment of the jet grout column will extend beneath the foundation. A further disadvantage of the jet grouting method is that the actual diameter of the jet grout column is not readily known. Test columns may be installed prior to production, however, such columns only predict the diameter of columns that will be achieved during production. Additional testing, such as exploratory drill holes, are required to verify the extent of soil-cement beneath a foundation, thereby confirming the level of underpinning support actually provided by the jet grout column.

Additional alternative methods of creating soil-cement elements other than jet grouting are available but are not readily applied to underpinning. Cylindrical soil-cement columns may be created by mechanical mixing. Most commonly, a drill rig rotates a hollow drill rod that has a combination of auger flighting and mixing paddles attached to the sides of the drill rods. Cement grout is injected into the soil through the hollow drill rod as the drill rod is inserted into the soil. Rotation of the drill rod provides mechanical mixing energy that combines the soil and grout, creating a fluid or semi-fluid soil-cement mixture similar in consistency to that created by jet grouting. However, because this method of creating soil-cement utilizes auger flighting and mixing paddles of fixed length attached to a drill rod positioned in a vertical or sub-vertical orientation, it is not generally possible to insert the tooling directly beneath a foundation.

In another example method of creating soil-cement via mechanical mixing, a cutting tool consists of one or more cutter drums rotating on the end of a shank attached to the arm of a working machine. The cutting tool may be attached or connected to a rigid extension. The rigid extension may be attached to the arm of a working machine. Attached to each cutter drum is an arrangement of mixing paddles, blades, and/or teeth that project from the surface of the cutter drum and engage the soil as the cutter drum is rotated. A hollow tube is located in proximity to the cutter drum through which dry cement is pneumatically conveyed to the area of soil being mixed. In a variation of this method, fluid cement grout is conveyed through the hollow tube rather than dry cement. In both instances, the cementitious material is mixed with soil as the cutting tool is inserted into the ground via the rigid extension attached to the working machine. The mechanical mixing creates a fluid or semi-fluid soil-cement mixture. This method of creating soil-cement is not suitable for underpinning because the rigid extension cannot, in its normal configuration, extend beneath a foundation (e.g., immediately below and/or in contact with a bottom surface of the foundation or existing structure). Indeed, users of this method are instructed to maintain the rigid extension in a vertical or sub-vertical inclination during the mixing process.

Yet another example alternative method of creating soil-cement utilizes a procedure commonly referred to as permeation grouting. In this method, cementitious or chemical grouts of a fluid nature are injected into soil through hollow tubes. The grout flows through voids between soil particles and permeates the soil for some distance around the hollow injection tube. The grout cures or hardens after a period of time, binding the soil particles together and creating a soil-cement mass with compressive strength similar to that created by mechanical soil mixing or jet grouting processes. The permeation method of creating soil-cement is suitable for underpinning foundations in some cases, but there are disadvantages as well. As with jet grouting, relatively small diameter drill rods or hollow tubing is used to inject the grout. In some cases, the injection tubing may be inserted through holes drilled in the foundation, but in other cases this will not be feasible and the injection tubing will be inserted into the soil adjacent to the foundation. The amount of treated soil beneath the foundation will vary accordingly. Also, as with jet grouting, the disadvantage exists that the extent of soil treated by permeation grouting is somewhat unknown. As with jet grouting, test columns can be installed to predict the penetration distance of the grout, but verification of the production columns is still required to determine the extent of underpinning support provided to the foundation. Lastly, similar to jet grouting, the type of soil will greatly influence the penetration of the grout and therefore the suitability of this method.

Accordingly, it would be advantageous to provide a safe, effective method of producing soil-cement underpinning elements with a predictable geometry and positioned below and in contact with a bottom surface of an existing foundation. Such a method would not be constrained to cylindrical or fan-shaped soil-cement elements, but rather would enable the production of substantially square or rectangular block-like elements with generally planar surfaces.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Aspects of the present invention relate to cutting tool adapters configured to enable creation of a substantially square or rectangular-shaped underpinning structure or element below an existing structure or foundation. In some examples, each cutting tool adapter is configured to connect a cutting tool to a working machine in order to enable mechanical soil-cement mixing in an area of soil below an existing structure or foundation.

Additional aspects are related to a method of forming an underpinning structure below an existing structure or foundation. In some examples, an approach pit adjacent to an area of soil below the existing structure may be created. A cutting tool with one or more rotating cutter drums or shafts connected to a working machine via a cutting tool adapter may be inserted into the approach pit and may be advanced forward, into the area of soil below the existing structure or foundation. The cutting tool may rotate 360° to enable cutting of the soil. The cutting tool may be advanced in a generally horizontal position, angled upward or angled downward, and may also be advanced laterally in either direction. As the cutter drum or shaft of the cutting tool rotates, additive such as cementitious material may be introduced to the area and mechanically mixed with the soil via the cutting tool, thereby creating a fluid or semi-fluid soil-cement mixture. The soil-cement mixture may then harden to create the underpinning structure.

These and various other aspects will be described more fully below.

DETAILED DESCRIPTION

Figure 1A:
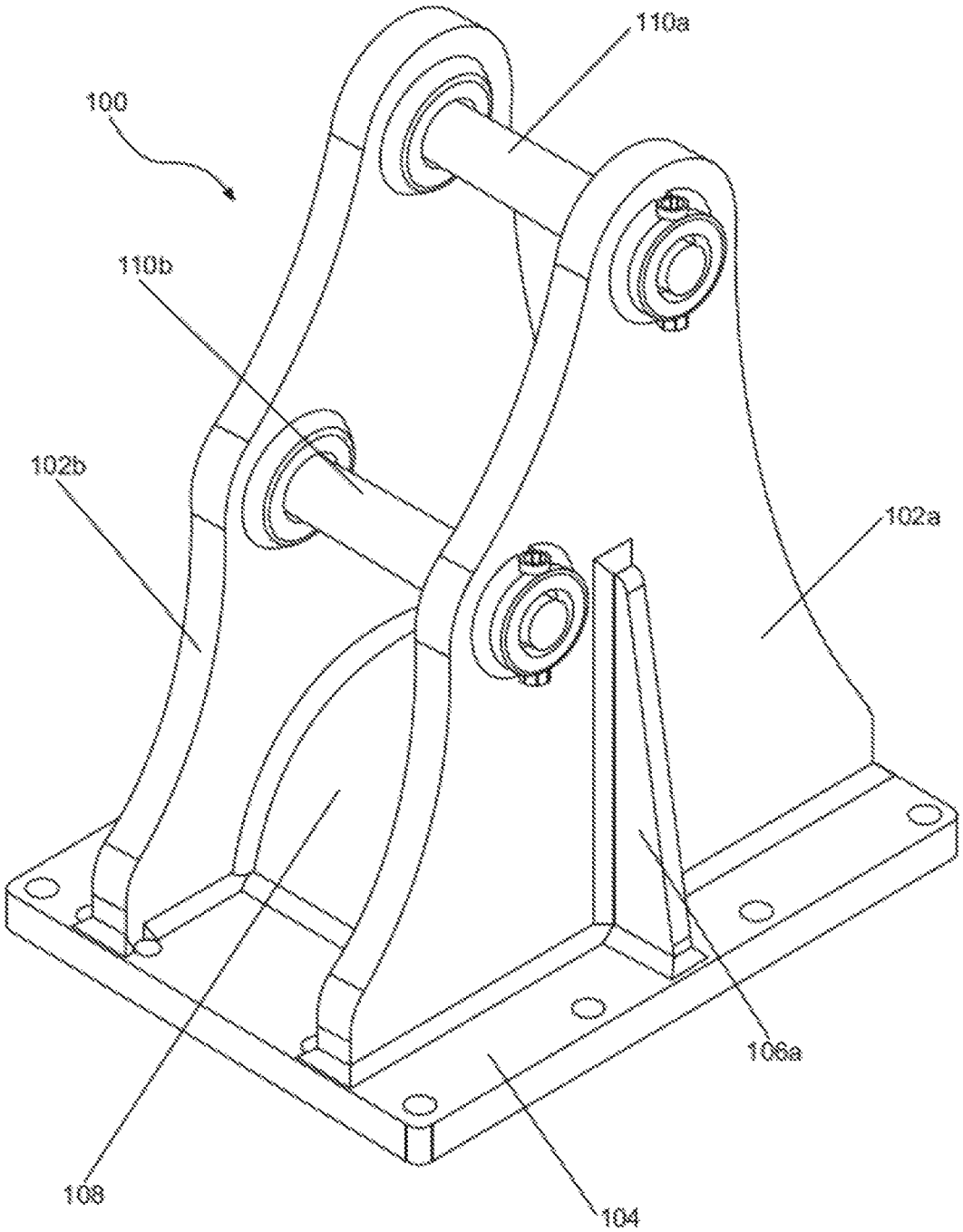
FIGS. 1A-1D illustrate one example cutting tool adapter according to one or more aspects described herein.

In the following description of the various embodiments, reference is made to the accompanying drawings, which form a part hereof, and in which is shown by way of illustration, various embodiments of the disclosure that may be practiced. It is to be understood that other embodiments may be utilized.

As discussed herein, aspects described are directed to a cutting tool adapter configured to connect a cutting tool to an arm of a working machine. The cutting tool adapter may enable use of one or more cutting tools to perform underpinning of an existing structure using, for example, soil-cement. Soil-cement may be used, in some examples, instead of concrete as it provides sufficient load bearing capacity, may be more cost effective, relies on more efficient methods of installation, and the like. For instance, while soil-cement may not have a same strength as concrete, it has a sufficient strength to transfer loads associated with an existing structure or foundation to the soil or rock of the bearing stratum. Soil-cement also has sufficient strength to be durable (e.g., soil-cement will not readily spall, abrade, fall apart on exposure to chemicals, or the like). For instance, soil-cement is strong enough to resist any other loads that may need to be applied, such as a horizontal stabilizing force. In some examples, concrete may have a typical unconfined compressive strength of 3,000 psi. Soil alone may have a typical unconfined compressive strength of 30 psi. Soil-cement may have a typical unconfined compressive strength between 50 and 2,000 psi, thereby providing sufficient strength to support any desired or necessary loads.

These and various other aspects will be described more fully herein.

For example, FIGS. 1A-1D illustrate one example cutting tool adapter. As shown, the cutting tool adapter includes a base plate 104. The base plate may include a first adapter arm 102*a* and a second adapter arm 102*b*. In some examples, the first adapter arm 102*a* and second adapter arm 102*b* may be formed as part of the base plate (e.g., as a single piece). In other examples, the first adapter arm 102*a* and second adapter arm 102*b* may be connected to the base plate 104 using one or more fasteners, welding operations, or the like. In some examples, when connected to the base plate 104, the first adapter arm 102*a* and second adapter arm 102*b* may extend parallel or substantially parallel to each other. Each adapter arm 102*a*, 102*b* may have two opposite generally planar surfaces connected by two side surfaces. In some examples, the side surfaces may be arcuate surfaces, as shown in the figures.

The first adapter arm 102*a* may include an upper aperture 112*a* and a lower aperture 114*a*. The second adapter arm 102*b* may include an upper aperture 112*b* and a lower aperture 114*b*. The upper apertures 112*a* and 112*b*, and the lower apertures 114*a* and 114*b* may be generally aligned when the first adapter arm 102*a* and second adapter arm 102*b* are connected to the base plate 104.

Figure 1B:
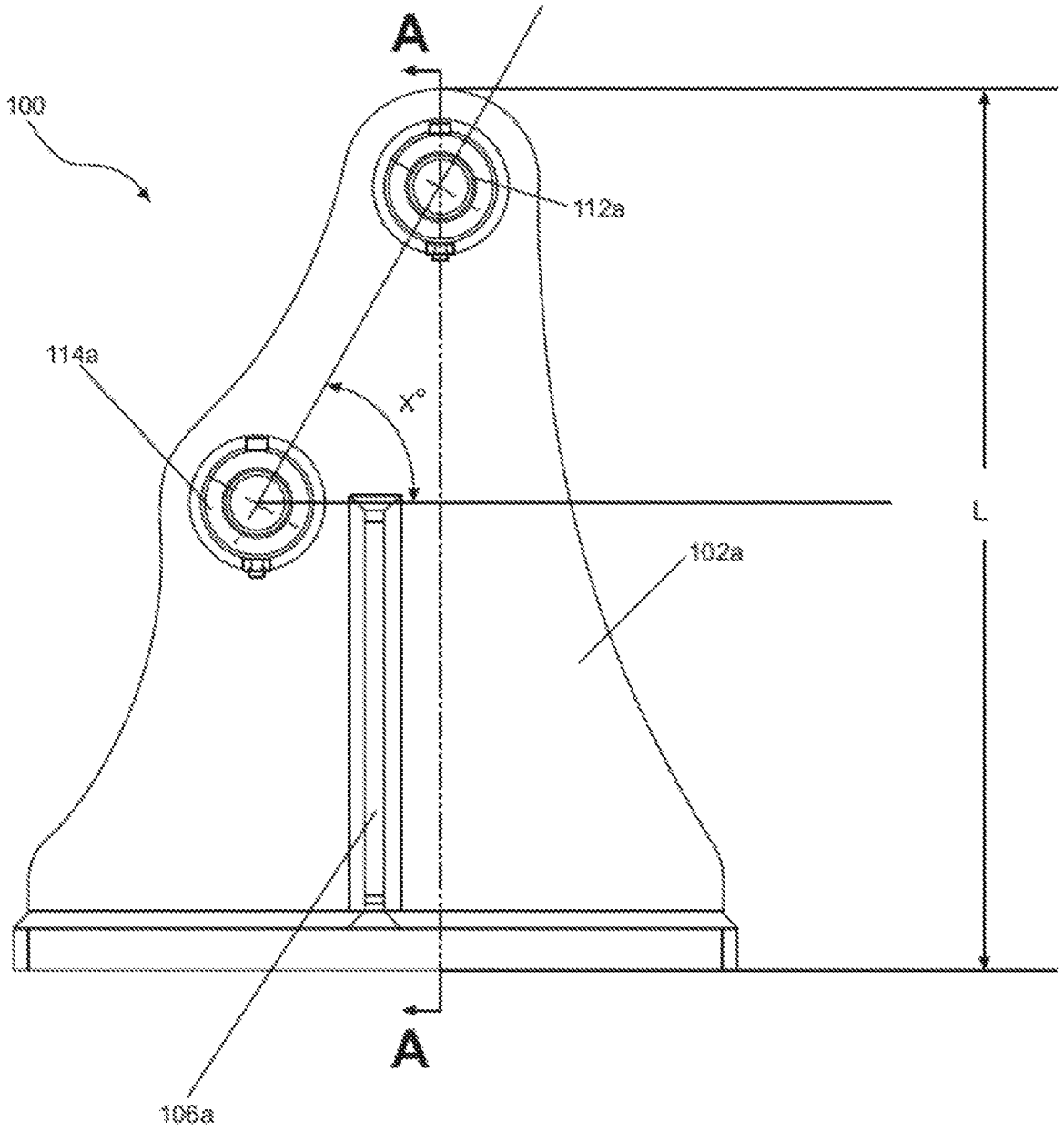

The cutting tool adapter 100 may further include a first connecting pin 110*a* and a second connecting pin 110*b*. The first connecting pin 110*a* may connect the first adapter arm 102*a* to the second adapter arm 102*b* by extending through upper aperture 112*a* and upper aperture 112*b*. The cutting tool adapter 100 may further include a second connecting pin 110*b*. The second connecting pin 110*b* may connect first adapter arm 102*a* to second adapter arm 102*b* by extending through lower aperture 114*a* and lower aperture 114*b*. In some examples, as shown in FIG. 1B, the first connecting pin 110*a* and the second connecting pin 110*b* may form an angle. FIG. 1B illustrates the angle as being X°. In some examples, X may be between 50 and 100 degrees. In other examples, X may be between 55 and 90 degrees. In some example arrangements, X may be a 60 degree angle. In some examples, an angle of 60 degrees may enable a hydraulic cylinder to rotate the attached cutting tool sufficiently to permit the cutting tool to extend upward, downward, and/or to contact the bottom surface of an existing structure, which, in some examples, is not achievable or is inefficient when using tools having other (e.g., smaller) angles.

Each connecting pin 110*a*, 110*b* may be secured using one or more fasteners. For instance, FIG. 1D is an exploded view of the cutting tool adapter 100 illustrating some example fasteners that may be used. For instance, the connecting pins 110*a*, 110*b* may be secured using fasteners 116, 118. In some examples, fasteners 116 may be any type of suitable screw. For example, fastener 116 may be a cylinder head cap screw. Fasteners 116 may extend through each connecting pin 110*a*, 110*b* via a flanged on an outer surface of each adapter arm 102*a*, 102*b* and surrounding each aperture 112*a*, 112*b*, 114*a*, 114*b*. The fastener 116 may be held in place using fasteners 118 which may be any suitable type of fastener. For example, fasteners 118 may be hex nuts.

In some examples, the first adapter arm 102*a* and second adapter arm 102*b* may further include a support fin to aid in securing the first adapter arm 102*a* and second adapter arm 102*b* to the base plate 104. For instance, a first support fin 106*a* may extend between a side surface of the first adapter arm 102*a* and the base plate 104. A second support fin 106*b* may extend between a side surface of second adapter arm 102*b* and the base plate 104. Each support fin 106*a*, 106*b* may aid in maintaining a position of each of the first adapter arm 102*a* and second adapter arm 102*b*.

In some examples, the first adapter arm 102*a* and second adapter arm 102*b* may further include a support element to aid in securing the first adapter arm 102*a* and second adapter arm 102*b* to the base plate 104 and to each other. For instance, support element 108 may extend between opposing side surfaces of first adapter arm 102*a* and second adapter arm 102*b* and may additionally be secured to base plate 104.

Figure 1C:
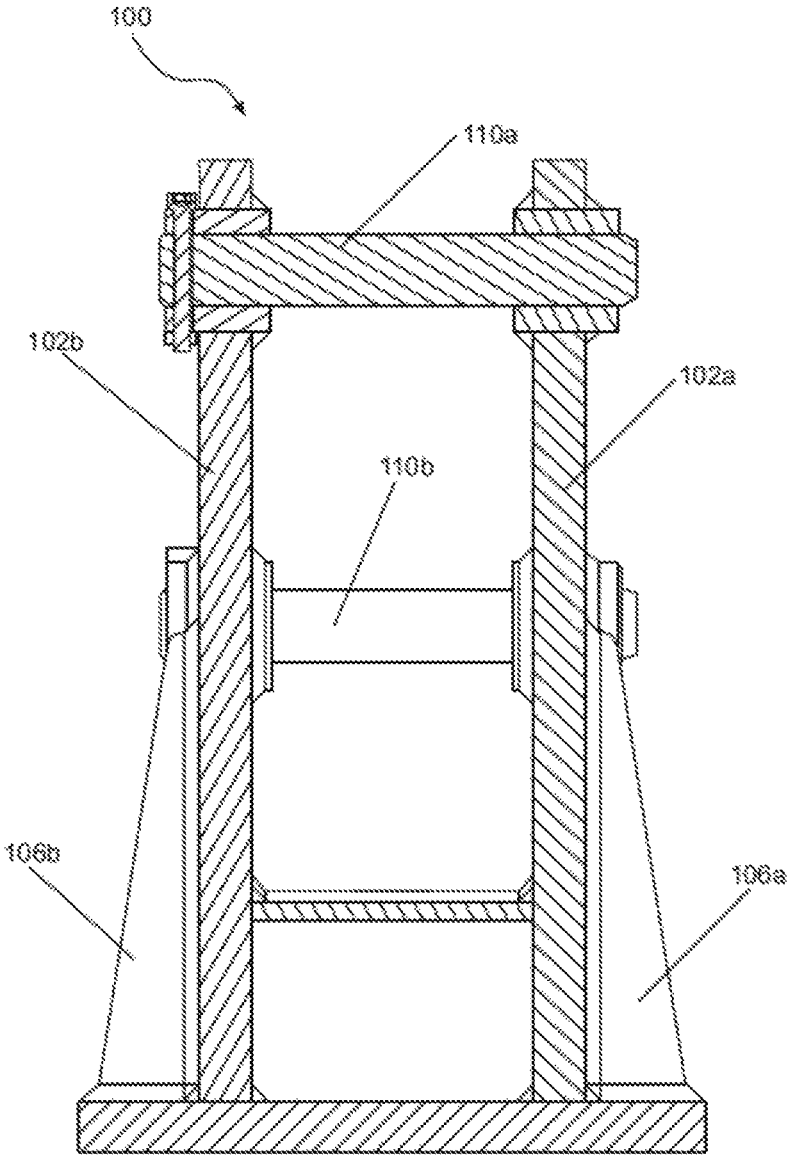
Figure 1D:
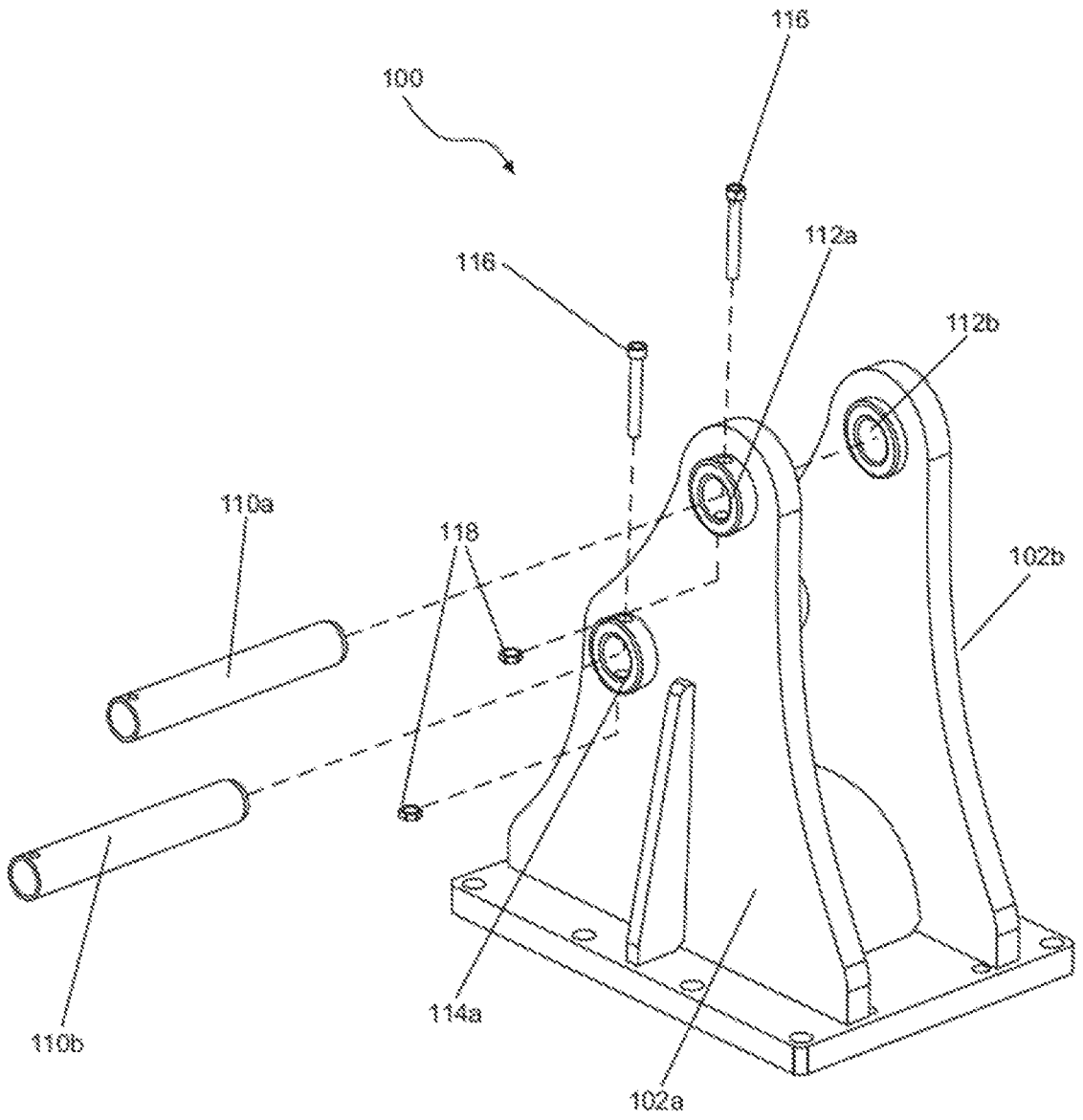

FIG. 1C is a section view of the cutting tool adapter taken along line A-A shown in FIG. 1B. FIG. 1C illustrates connecting pin 110*a* extending between first adapter arm 102*a* and second adapter arm 102*b*. FIG. 1C further illustrates support fins 106*a* and 106*b*.

The cutting tool adapter 100 may be connected to an arm of a working machine, such as an excavator or other earth moving piece of equipment, to enable a cutting tool (e.g. a transverse or axial cutter or mixing tool) to project horizontally, inclined upwards (e.g., with respect to a horizontal plane), or inclined downwards (e.g., with respect to a horizontal plane). In some examples, the cutting tool adapter 100 may be fastened or connected to the working machine arm at two pin locations (e.g., first connecting pin 110*a* and second connecting pin 110*b*). In some examples, one pin location (e.g., first connecting pin 110*a*) may be fixed and serve as an axis of rotation. Another, different pin location (e.g., second connecting pin 110*b*) may be connected to a hydraulic cylinder (e.g., a bucket cylinder). Accordingly, extension or retraction of the hydraulic cylinder may cause the adapter plate to rotate relative to the working machine (e.g., about the first connecting pin 110*a*) and may subsequently cause the cutting tool to rotate relative to the working machine (e.g., an arm of the working machine). Rotation of the cutting tool relative to the working machine may enable positioning of the cutting tool in various locations. A portion of the cutting tool itself may then rotate (e.g. the cutter drum or shaft) to cut and dislodge the earth from below the existing structure or foundation and, in some examples, to contact a bottom surface of the existing structure or foundation. In some examples, the cutting tool adapter may be rotated (e.g., with the cutting tool) by a rotating device attached to the arm of the working machine. In this example, the rotating device may operate independently of the hydraulic cylinder to rotate the cutting tool relative to the arm of the working machine. Rotation of the cutting tool thereby enables the cutting tool to cut and dislodge earth from below the existing structure or foundation and, in some examples, to contact a bottom surface of the existing structure or foundation.

The cutting tool adapter 100 may, in some examples, be between 5 inches and 72 inches in length (e.g., dimension L in FIG. 1B). In some arrangements, the cutting tool adapter 100 may be between 8 inches and 32 inches in length (e.g., dimension L in FIG. 1B). In still other examples, the cutting tool adapter 100 may be between 15 inches and 25 inches in length (e.g., dimension L in FIG. 1B). In some examples, this length may enable the cutting tool to extend a desired distance under the existing structure or foundation. The cutting tool adapter 100 may be formed of any suitable material including various metals, composites, or the like.

Figure 2A:
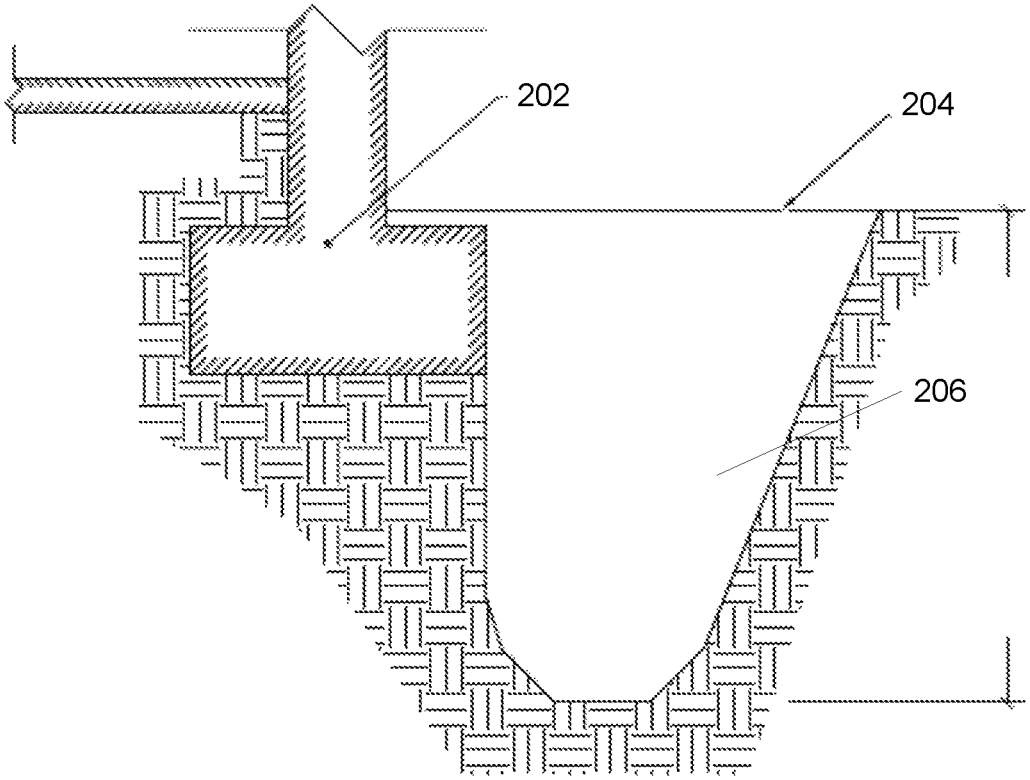
FIGS. 2A-2I illustrate example excavation site and underpinning arrangements formed using the cutting tool adapter and other aspects described herein.

FIGS. 2A-2I illustrate one example process for using a cutting tool adapter, such as cutting tool adapter 100 in FIGS. 1A-1D, in conjunction with a working machine for use in underpinning an existing structure or foundation. For instance, FIG. 2A illustrates one example excavation site for underpinning an existing structure or foundation. The existing structure 202 includes a foundation formed of concrete or other suitable materials. As shown in FIG. 2A, in some examples, an approach pit 206 may be dug along the existing foundation 202. In some examples, the approach pit 206 may be dug prior to starting the soil mixing process. In other examples, the soil cement mixing process may begin at the ground surface 204 and the approach pit may be created during the soil cement mixing process. The approach pit 206 may be dug to any suitable depth below the existing grade 204 of the work site. In some arrangements, the approach pit 206 may be a depth of between four (4) and six (6) feel below the existing grade 204 of the work site. This arrangement may enable access to portions of the work site below the existing foundation 202 of the structure. For instance, the approach pit 206 may enable a cutting tool, such as a cutting tool connected to a working machine via the cutting tool adapter, to access portions of the work site below the foundation 202 of the existing structure prior to starting the soil mixing process. Furthermore, as will be evident later in the process, the approach pit 206 may provide a space for excess soil-cement mixture to collect during the underpinning process.

Figure 2B:
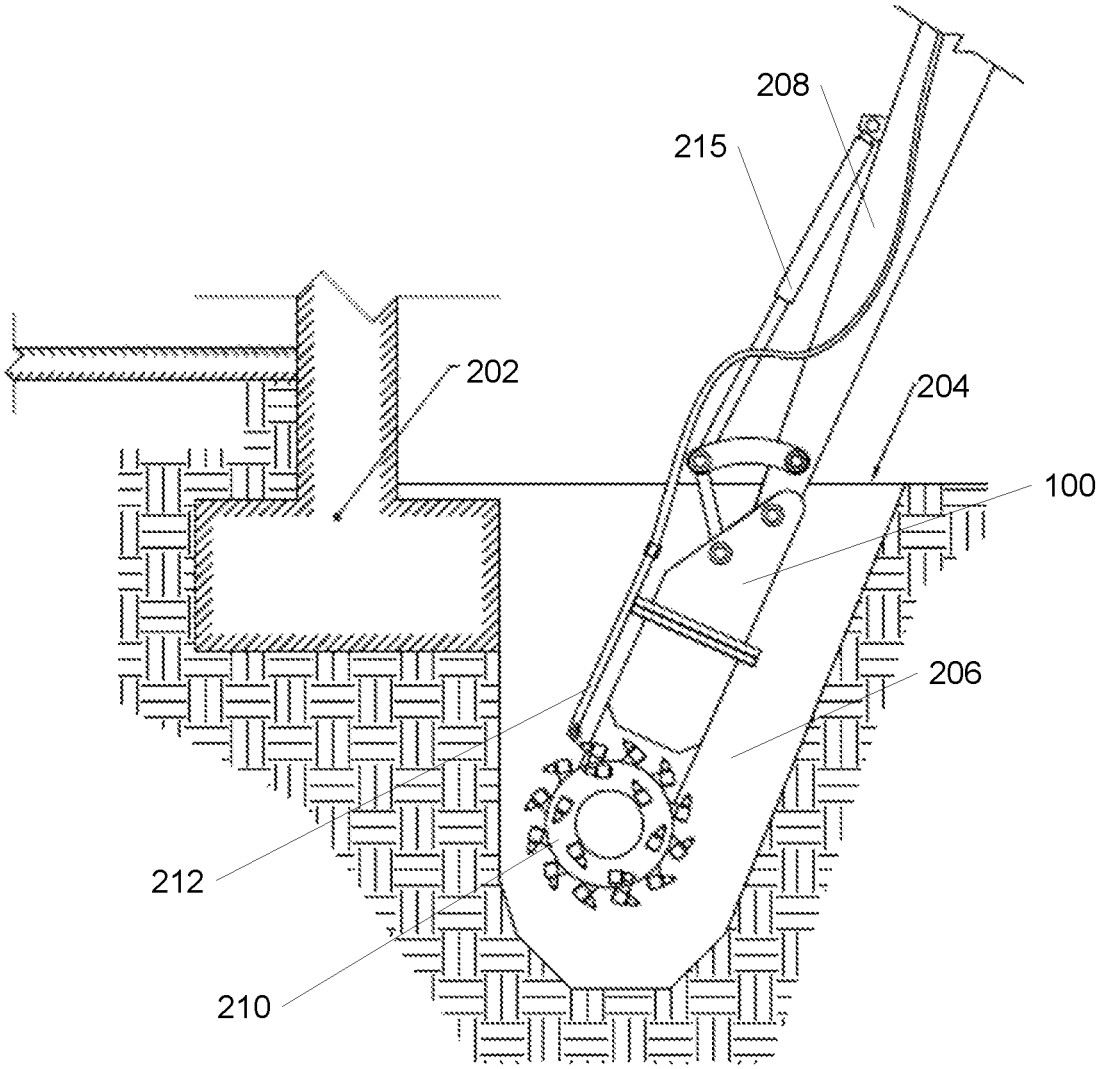

FIG. 2B illustrates the excavation site including a cutting tool within the approach pit 206. In some examples, a working machine arm 208 may be used to remove soil located adjacent to and below the existing foundation 202. The working machine arm 208 may be connected to a cutting tool 210 (shown schematically) via a cutting tool adapter, such as adapter 100 in FIGS. 1A-1D, adapter 500 in FIG. 5, adapter 600 in FIGS. 6A-6D, or the like. Various types of cutting tools, such as axial cutting tools, transverse cutting tools, soil mixing tools, and the like, may be used without departing from the invention. For instance, a cutting tool with a singular cutter drum rotating about a generally vertical axis may be described as an axial cutting tool. The axis of rotation of an axial cutting tool may be within a plane established by the arm of the working machine. In another example, a cutting tool with two cutter drums mounted in spaced relation and rotating about a generally horizontal shared axis is described may be described as a transverse cutting tool. The axis of rotation of a transverse cutting tool may be generally transverse to a plane established by the arm of the working machine.

The cutting tool 210 is shown in FIG. 2B as substantially aligned with the working machine arm 208. This arrangement of the equipment may be at a start of an excavation process. The cutting tool 210 may be inserted into the approach pit 206 and the cutter drums or shafts may rotate to begin cutting and mixing soil.

The working machine may be used to advance the cutting tool 210 forward from the approach pit 206 (in arrangements in which an approach pit is dug before the soil cement mixing process, or, alternatively, downward and then forward from the ground surface 204) and under the existing foundation 202. The cutting tool 210 may then cut and dislodge and partially remove soil from an area located below the existing foundation 202 in preparation for underpinning the existing structure or foundation. The cutting tool 210 may be moved laterally (e.g. to the left and to the right) as it is advanced under the existing foundation 202, thereby cutting and dislodging soil within the extents of the underpinning area. The cutting tool 210 may also be moved upward and downward to enable thorough mixing of the soil cement.

As the cutting tool 210 advances under the existing foundation, cementitious material may be introduced to the area via additive addition line 212. In some examples the cementitious material may include a cement powder mixed with water that, when mixed with soil, may harden to form an underpinning structure. In some examples, the ratio of water to cement (by weight) may range from 0.7 to 2.0. In some examples, the cementitious material and water may be introduced as separate components to the area without using additive addition line 212, (e.g. via direct placement). Accordingly, as the cementitious material is introduced into the area below the existing foundation 202, it may be mechanically mixed with the soil via the rotating cutter drums or shafts of the cutting tool. The mechanically mixed soil and cementitious material may form a fluid soil-cement that fills the approach pit and the area below the existing foundation. The fluid soil-cement 214 may then harden to form the underpinning element to support the existing structure 202. In some examples, the soil-cement will contain between 200 and 1000 lbs of cement per cubic yard.

Figure 7B:
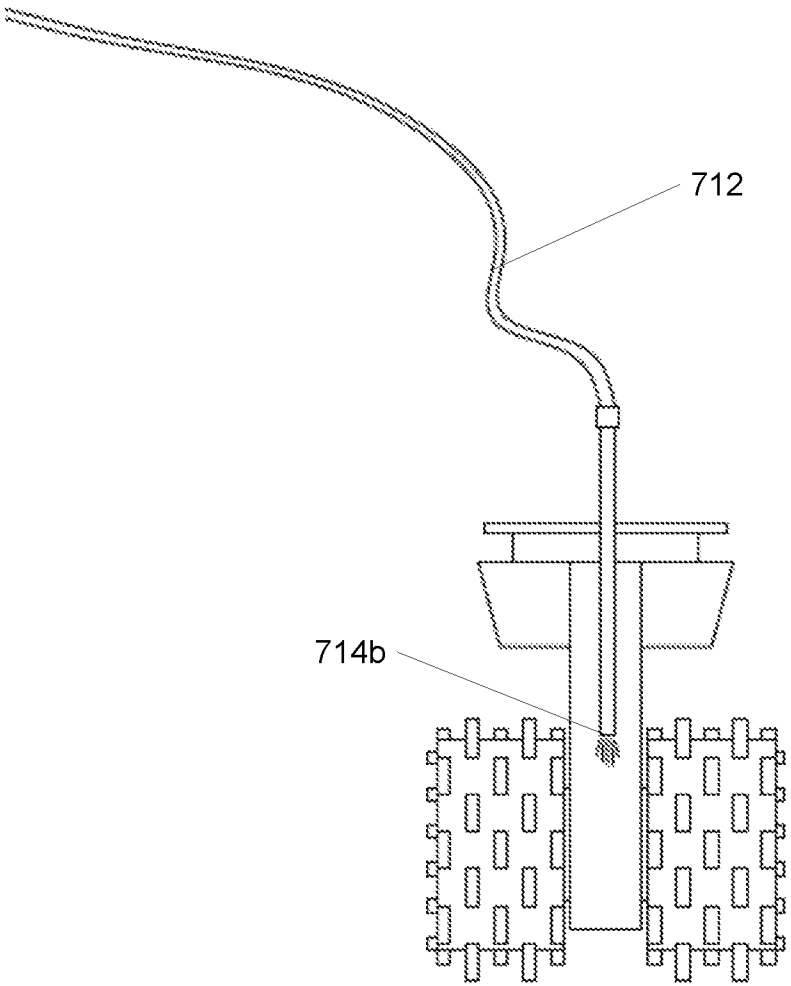
FIGS. 7A and 7B illustrate example additive addition line arrangements in accordance with one or more aspects described herein.

The addition of cementitious slurry via the additive addition line may be performed at a variety of delivery pressures and piping arrangements. In some examples, such as shown in FIG. 7B, the additive addition line 712 may terminate as an open-ended pipe or tube 714*b* through which low pressure cementitious slurry flows into the area of mixing. In such examples, the cementitious slurry may be pumped to the mixing area using line pressures typically ranging from 25-500 psi. In such examples, mechanical mixing is adequate to combine the soil and cementitious slurry to create soil-cement.

Figure 7A:
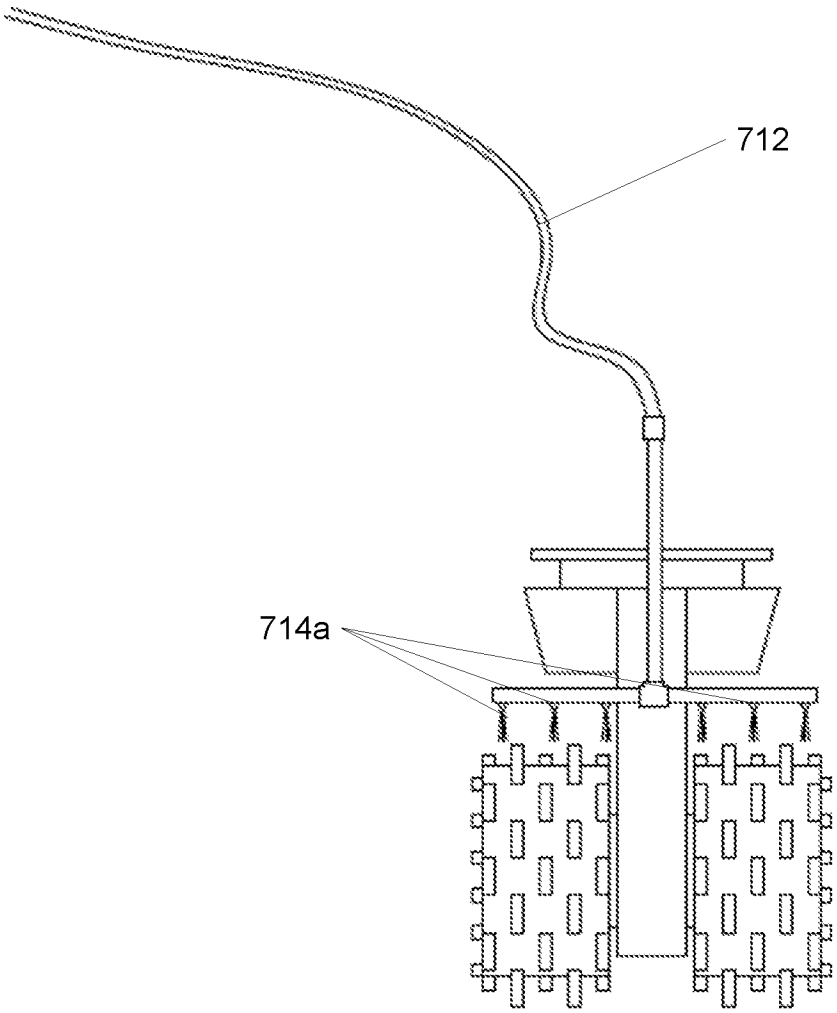

In contrast, in some examples (e.g. clay or clayey soils), mechanical mixing alone may not be sufficient to combine the soil and cementitious slurry in an efficient manner. In these examples, such as shown in FIG. 7A, the additive addition line 712 may terminate in one or more nozzles or restrictions 714*a* through which high pressure cementitious slurry is injected into the area of mixing. In such examples, line pressures typically ranging from 500 to 6,000 psi may be used to pump the cementitious slurry through the nozzles. The concentrated flow of slurry through one or more nozzles may be directed at or near the cutter drums to assist in the mixing of the soil and slurry. The concentrated flow of slurry may remove soil adhering to the cutter drums and it may also cut and mix the soil near the cutter drums, creating a fluid or semi-fluid soil-cement mixture.

Advantageously, the cutting tool 210 may be used to cut and dislodge soil to any desired depth and may be used to remove and/or mix soil from a bottom of an underpinning depth to a bottom surface of the existing structure or foundation 202. For instance, the cutting tool 210 may cut and dislodge soil adjacent or immediately adjacent to the bottom surface of the existing foundation 202 and may mix the soil with cementitious material in order to create soil-cement that will harden in contact with the existing structure 202. This may ensure continuous vertical support for the existing structure. In addition, this continuous support may be generated via a single soil-cement mixing process, rather than requiring additional steps to insert or otherwise add a portion of an underpinning to span a gap between an underpinning element and the bottom of the existing foundation 202 that may be generated when other, conventional underpinning arrangements or processes are used.

Advantageously, the cutting tool 210 may also be used to cut and dislodge soil across any desired width measured parallel to the existing structure or foundation and to any desired horizontal distance back, measured perpendicular from the front of the existing structure or foundation. The cutting tool may mix the soil with cementitious material to create soil-cement that will harden in contact with the existing structure 202. This may provide an underpinning element composed of substantially planar surfaces that may be preferable to the cylindrical elements generated when other conventional methods are used to generate soil-cement elements fully or partially beneath existing structures or foundations.

Figure 2C:
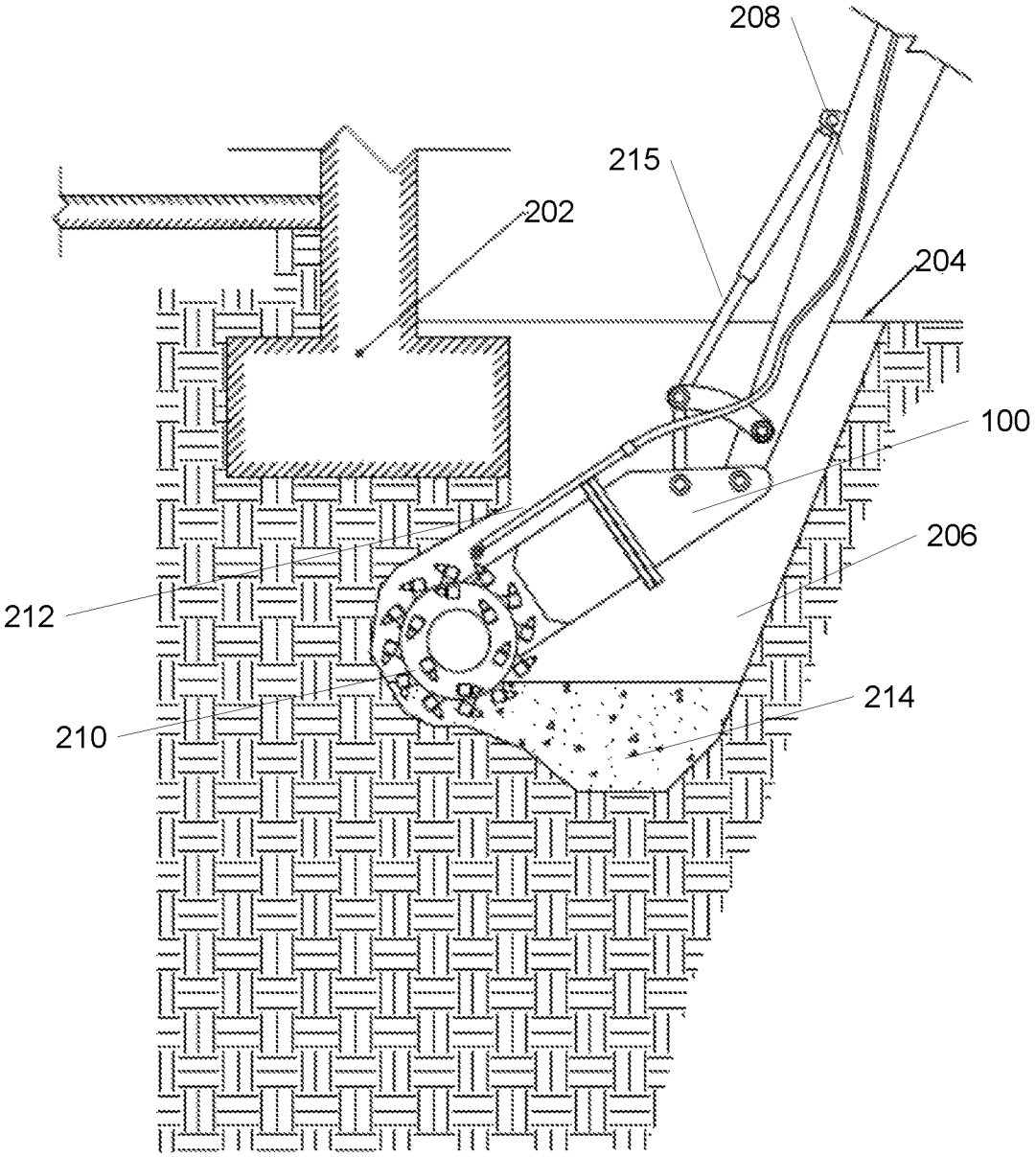
Figure 2D:
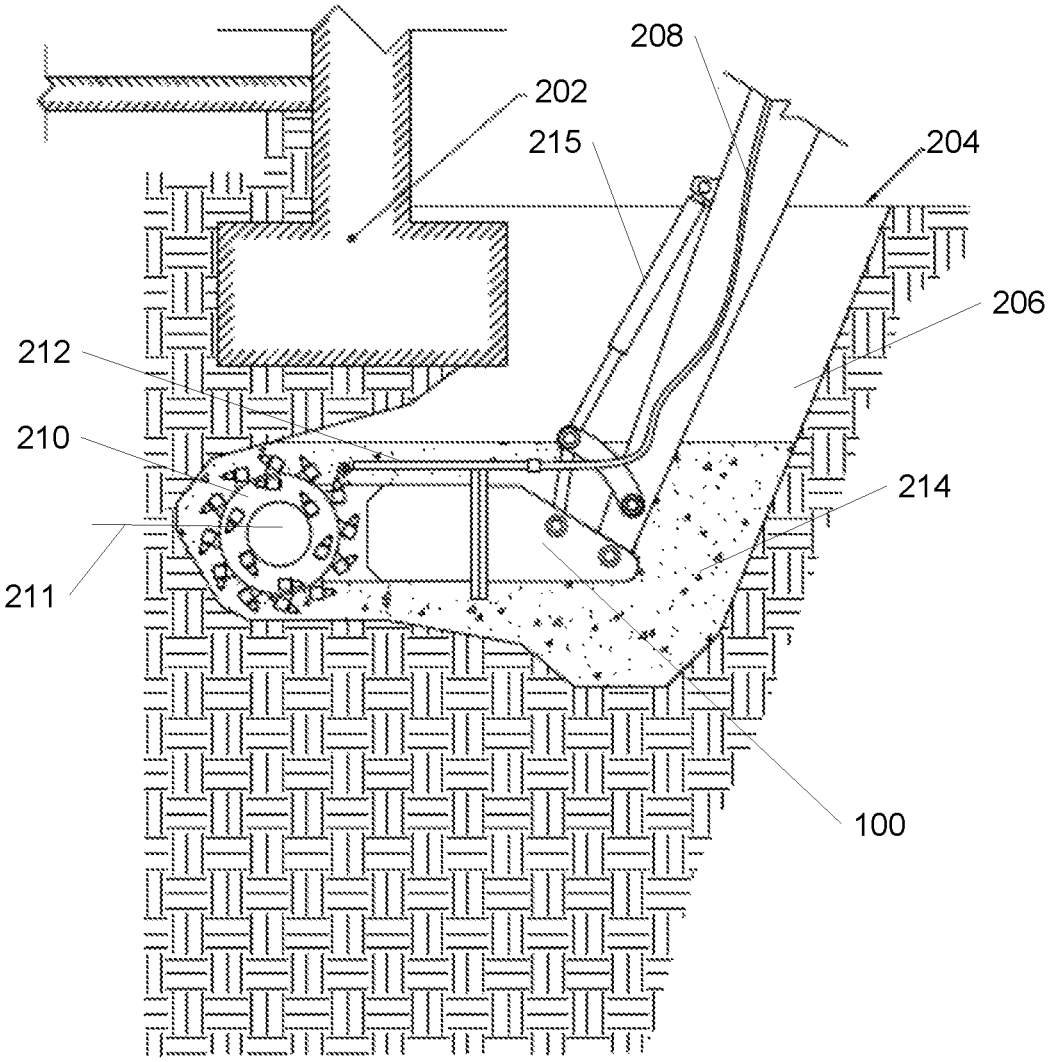
Figure 2E:
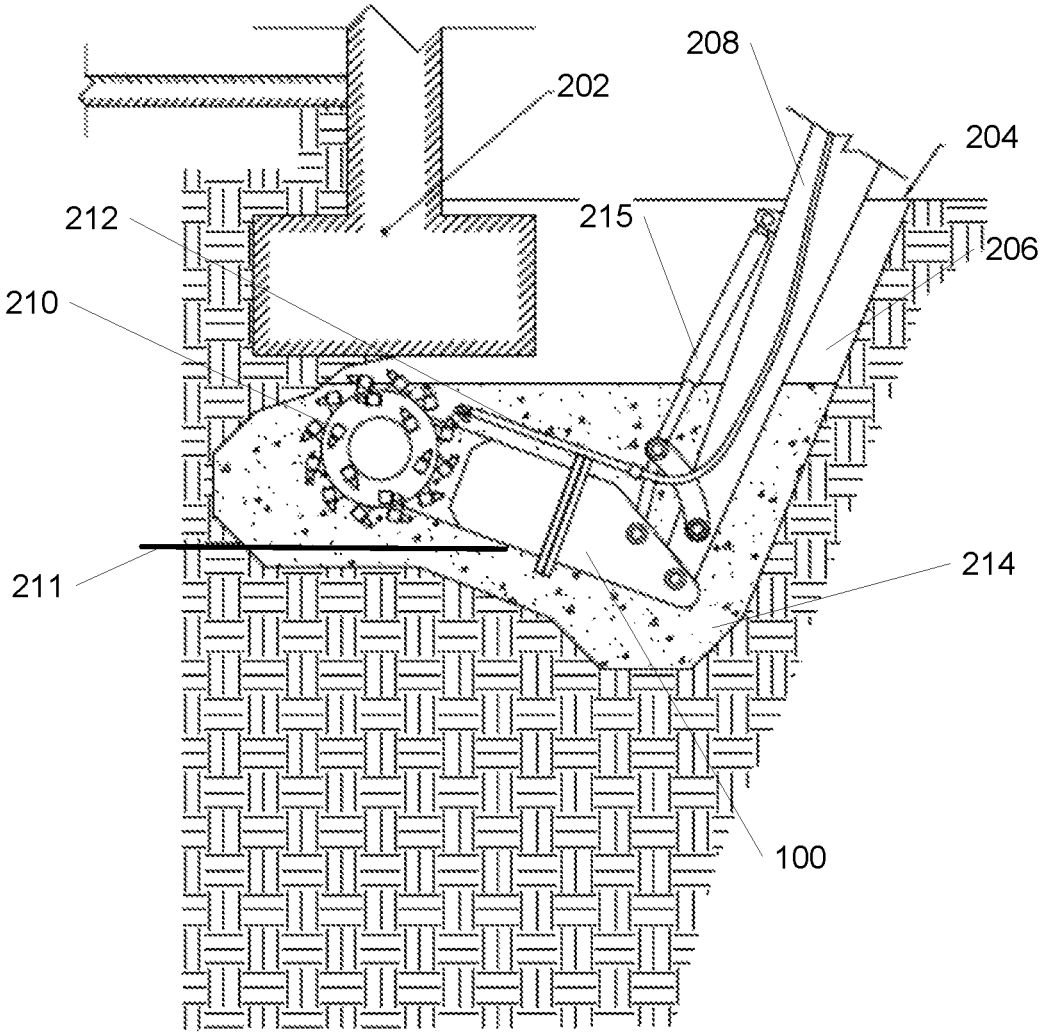

As shown in FIG. 2C, the cutting tool 210 may rotate relative to the working machine arm 208. For instance, as shown in FIG. 2C, the hydraulic cylinder 215 may be extended or retracted to rotate the cutting tool 210 about one of the connecting pins in the cutting tool adapter 100. Accordingly, the cutting tool 210 may extend forward of the working machine arm 208 to extend below or beneath the existing structure 202. The cutting tool 210 may extend below a generally horizontal plane, as shown in FIG. 2C (e.g., the cutting tool 210 may be positioned below or at a lower elevation than a bottom of the working machine arm or point of rotation of the cutting tool adapter 100) or may extend in a substantially horizontal position as shown in FIG. 2D (e.g., along a horizontal plane as shown by line 211 in FIG. 2D). In some examples, the cutting tool adapter 100 connecting the cutting tool 210 to the working machine arm 208 may be used to angle the cutting tool 210 to an upward position (e.g., the cutting tool 210 may be positioned above or at a higher elevation than a bottom or distal end of the working machine arm 208 or point of rotation of the cutting tool adapter 100) as shown in FIG. 2E. The working machine arm 208 may continue to advance the cutting tool 210 further under the existing structure 202 and deeper below the existing structure by positioning the cutting tool at various angles to remove and mix soil and cementitious material to generate soil-cement. The working machine arm 208 may also move laterally throughout the process, thereby moving the cutting tool laterally as it advances further and deeper below the existing structure and removes and mixes soil.

Figure 2F:
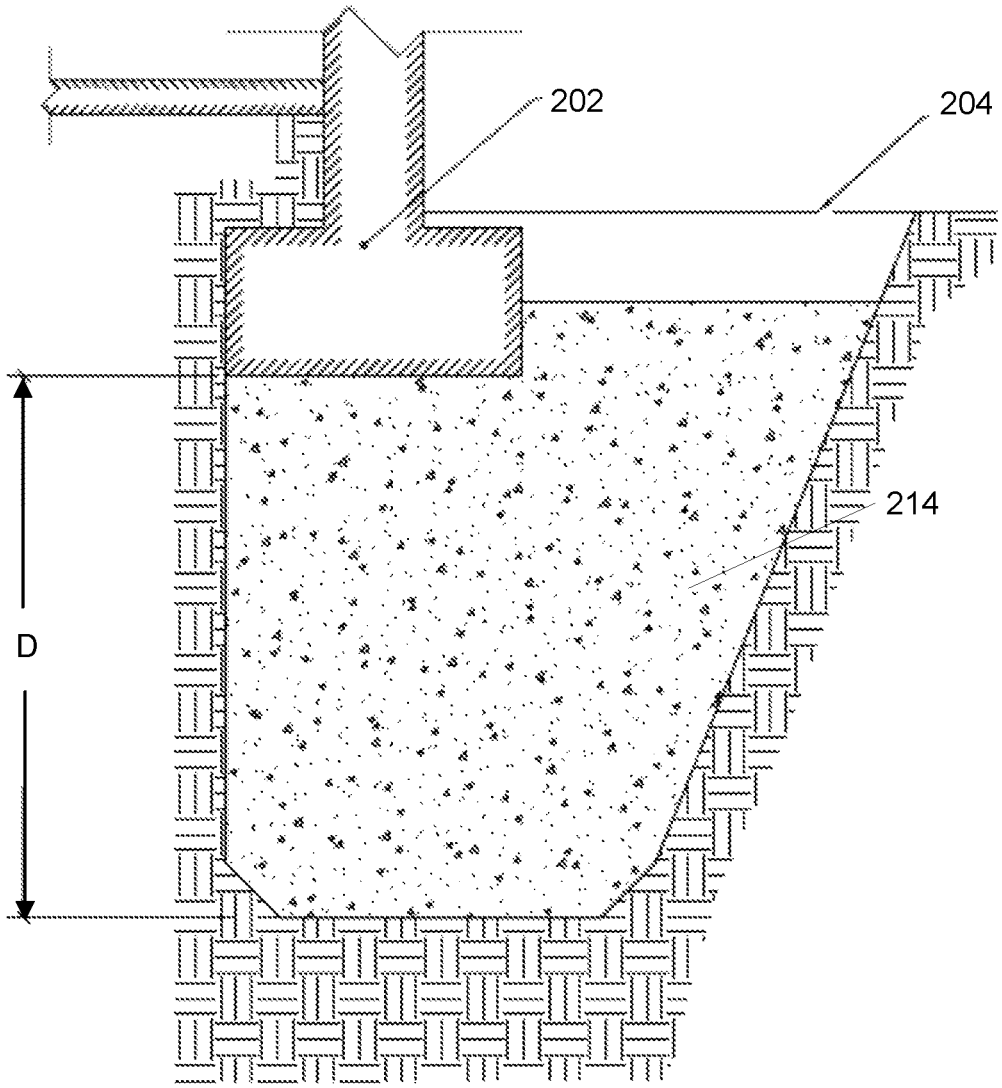
Figure 2G:
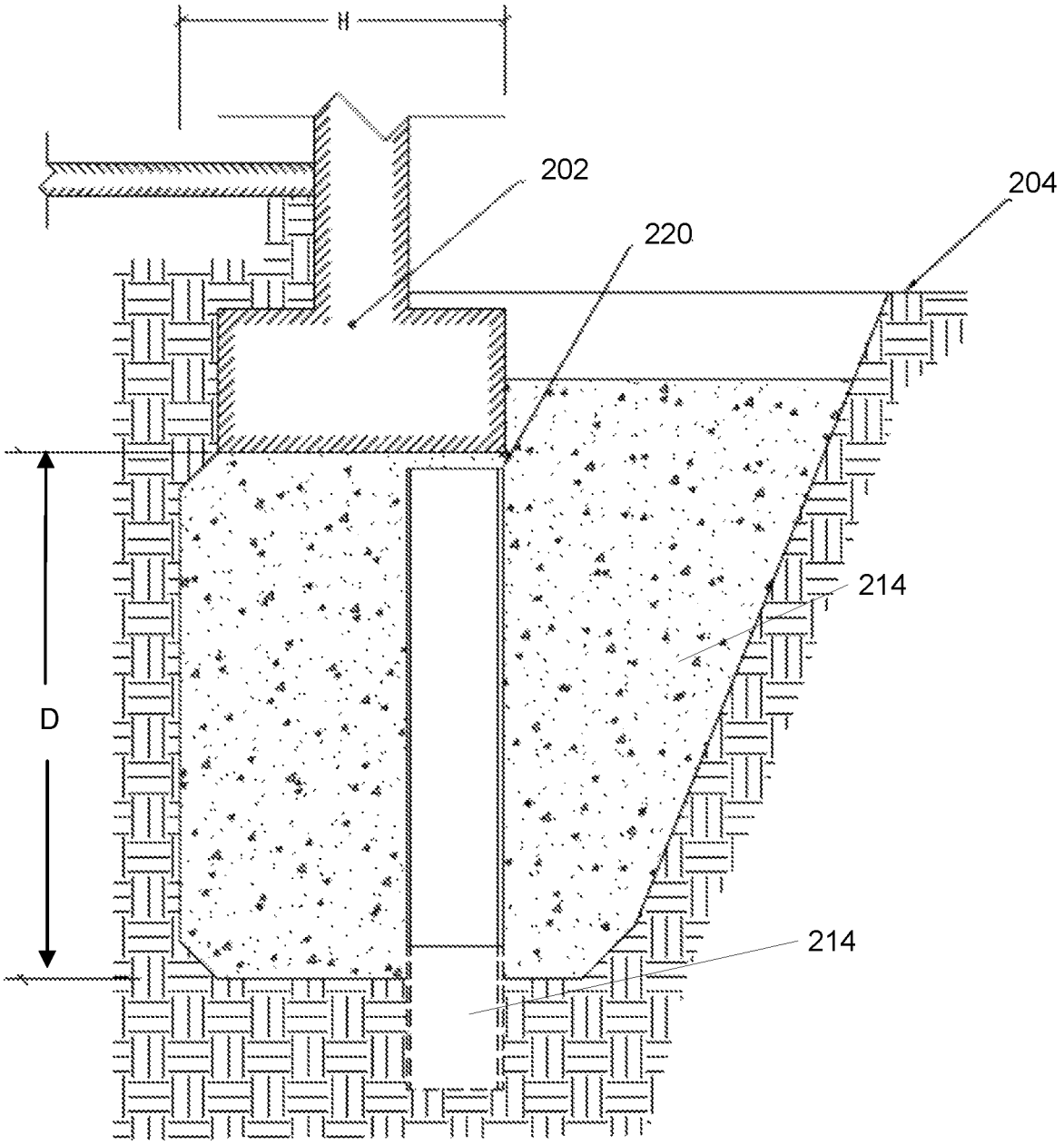

FIG. 2F illustrates a finished underpinning support structure or element formed of hardened soil-cement and created using the method described herein. As shown in FIG. 2F, the underpinning extends to a depth, D below the existing structure 202 and is in contact with the bottom surface of the existing foundation 202. In some examples, depth D may be between two (2) and 20 feet. As shown in FIG. 2G, the underpinning extends a horizontal distance, H, back from the front of the existing foundation. In some examples, horizontal distance H may be between two (2) and five (5) feet. In some examples, the width of the underpinning element measured parallel to the front surface of the existing foundation may be between 2 and 8 ft. In some examples, the top surface of the soil-cement underpinning material may extend alongside and above the bottom of the existing foundation 202 to provide a finished surface below the existing grade 204.

FIG. 2G illustrates one example optional arrangement in which an additional reinforcing member 220 is positioned below the existing structure 202. In some arrangements, as desired, one or more reinforcing members 220 may be inserted into the fluid soil-cement (e.g., before hardening occurs) to provide additional load bearing capacity to the soil-cement element and/or the existing structure. In some arrangements, the reinforcing members may be extended below the bottom of the soil-cement element 214 to develop additional load carrying capacity. FIG. 2G includes portion 222 of reinforcing member 220 that extends below the bottom of the soil-cement element 214.

Figure 2H:
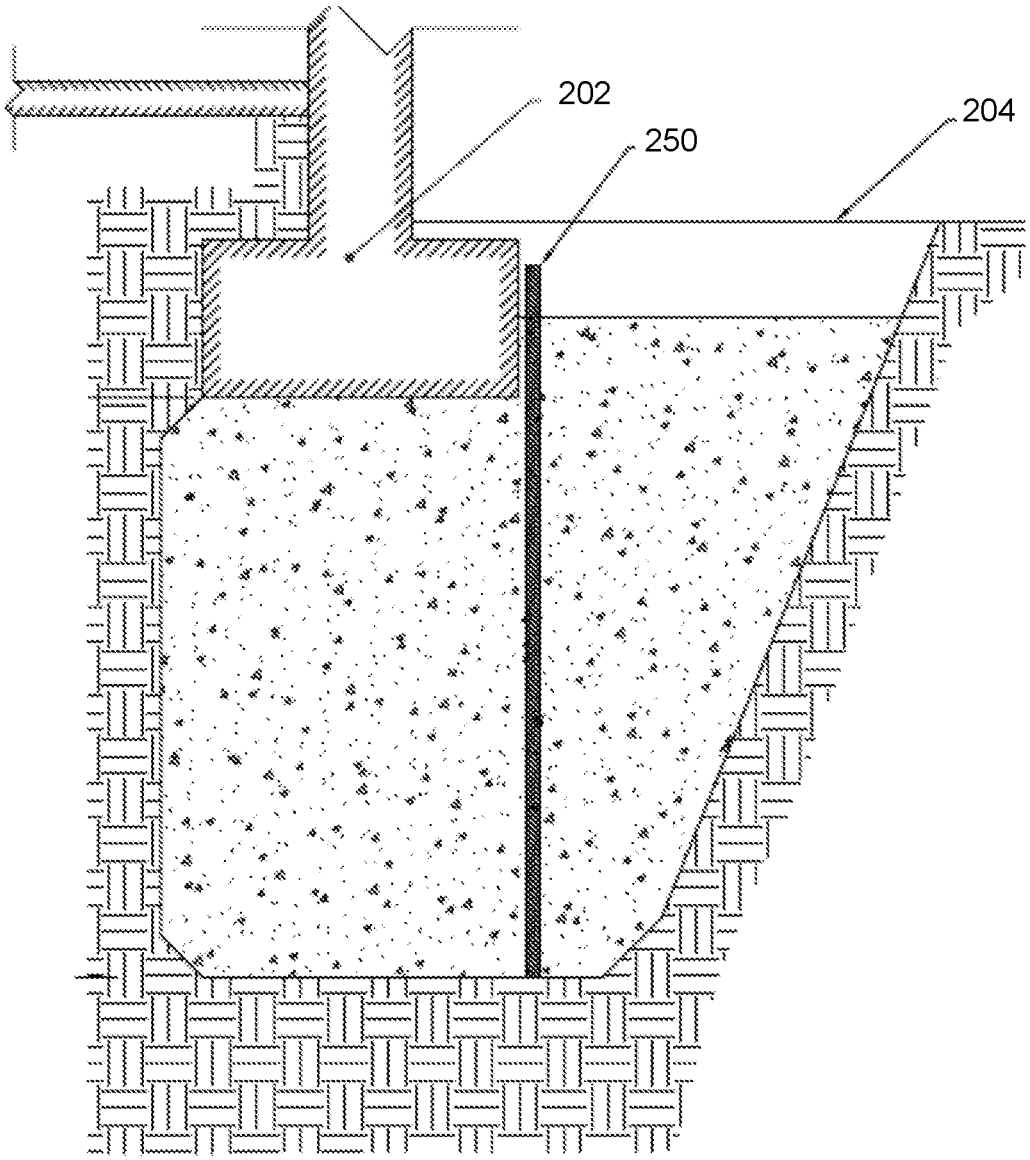

FIG. 2H illustrates another example arrangement in which a partitioning device 250 may be inserted into the fluid soil-cement (e.g., before hardening). For example, a partitioning device 250 may be inserted into the fluid soil-cement (e.g., below the existing structure or foundation, along an outside edge of an existing structure or foundation, or the like) to exclude portions of the soil-cement mixture that extend beyond (e.g., in a generally horizontal direction) the portion of the existing structure or foundation requiring support.

Figure 2I:
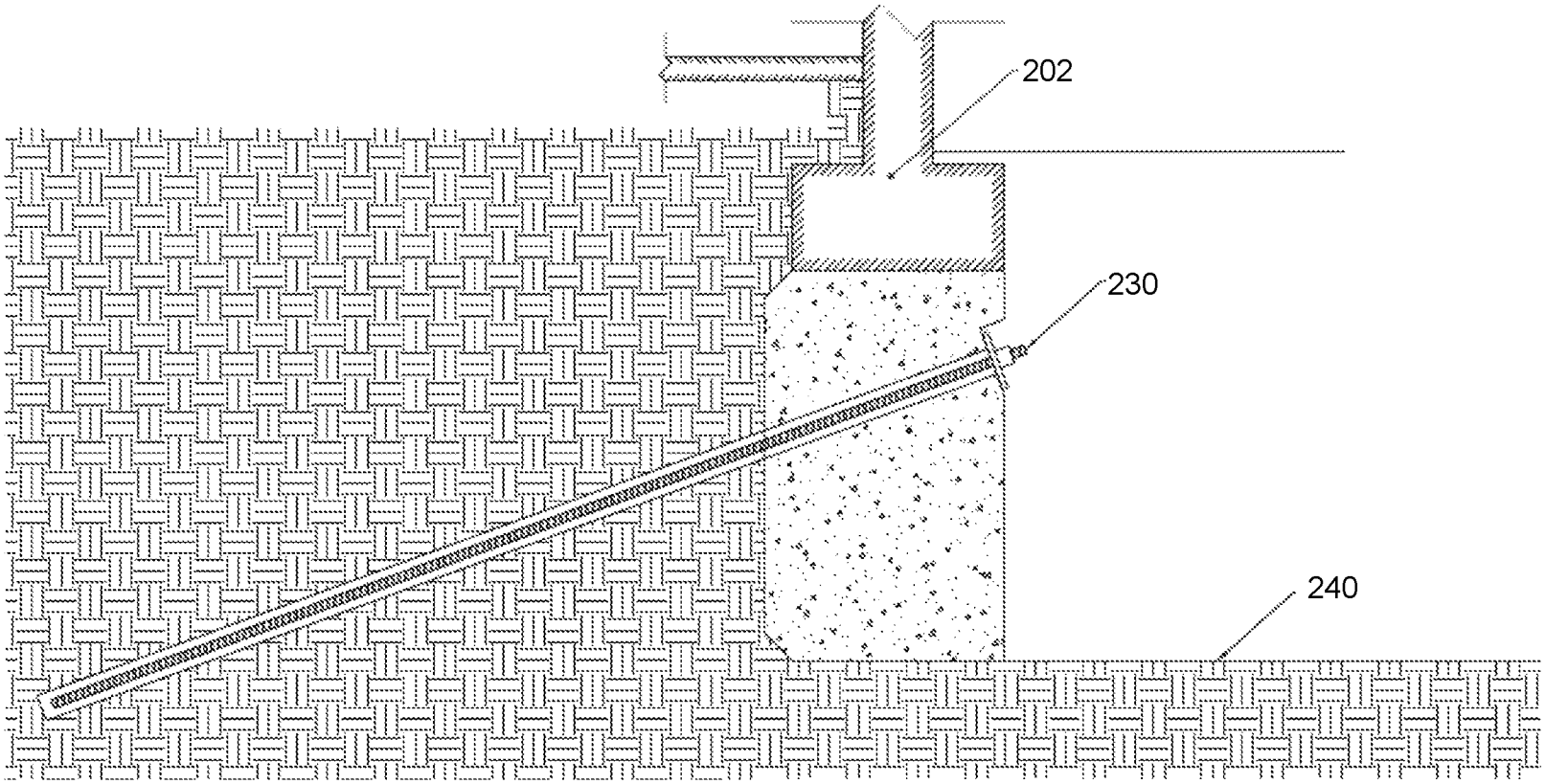

FIG. 2I illustrates another example optional arrangement in which an additional support member 230 is positioned below the existing structure 202. In some arrangements, as desired, one or more support members may be installed through the hardened soil-cement to provide horizontal and/or vertical support to the soil-cement element.

Figure 3:
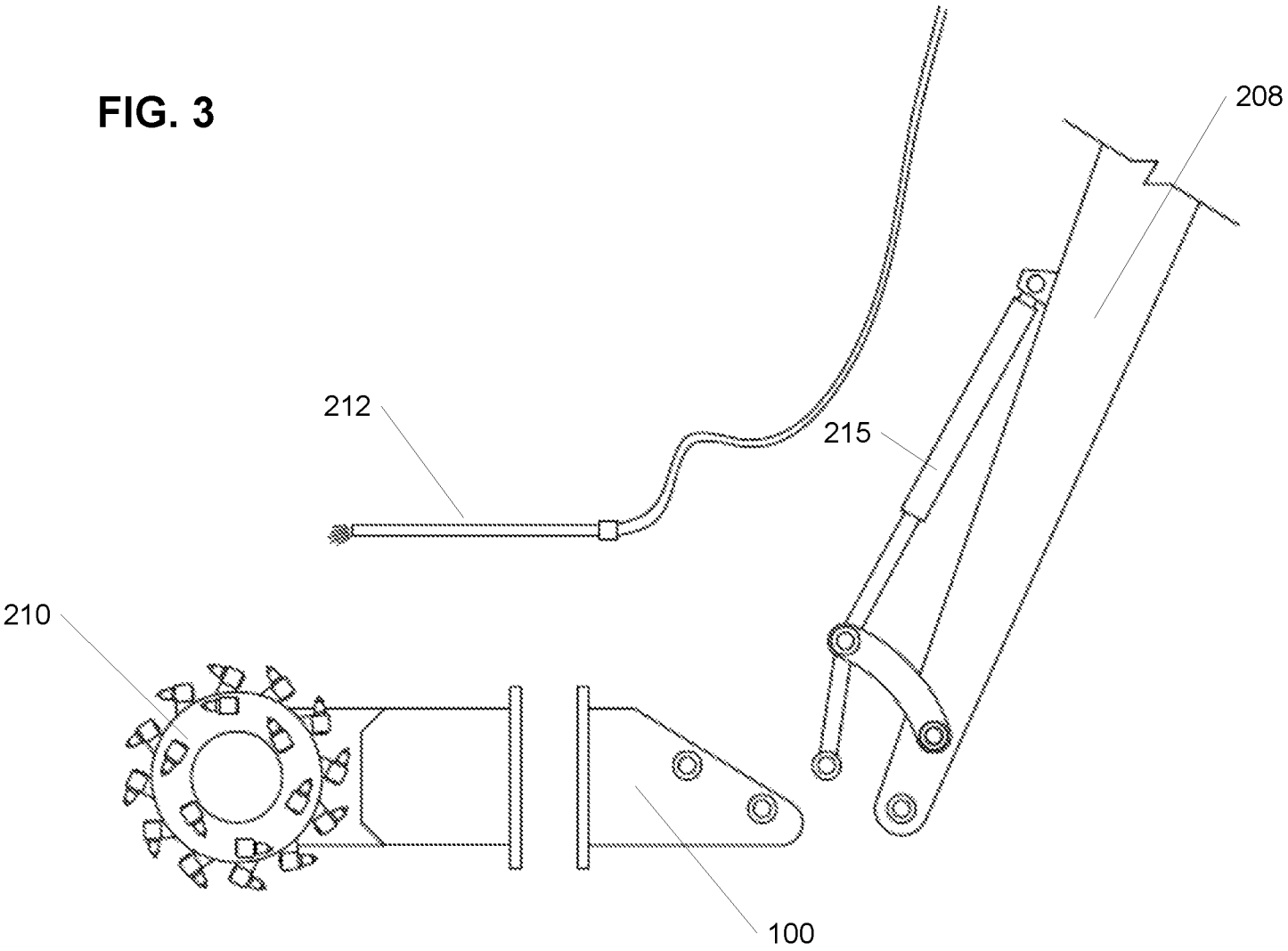
FIG. 3 is an exploded view of one example cutting tool adapter and associated working machine arm and cutting tool in accordance with one or more aspects described herein.

FIG. 3 illustrates an exploded view of the working machine arm 208, cutting tool adapter 100 and cutting tool 210. As discussed herein, the working machine arm 208 may be connected to a first pin location (e.g., first connecting pin 110*a* in FIGS. 1A-1D) and may be fixed to provide a point of rotation about which the cutting tool adapter 100 and cutting tool 210 may rotate. The hydraulic cylinder 215 may connect to another pin location (e.g., second connecting pin 110*b*) and extension or retraction of the hydraulic cylinder 215 may cause the cutting tool adapter 100 and cutting tool 210 to rotate about pin 110*b* and relative to the working machine arm 208.

The cutting tool adapter 100 may then be connected to the cutting tool 210 using, for example, fasteners such as screws, bolts, or the like. The additive addition line 212 may be used to introduce cementitious material to the soil in order to fluidize the soil to enable the cutting tool 210 to advance through the soil and mix the soil with cementitious or other material via cutting tool 210 to generate soil-cement.

Figure 4:
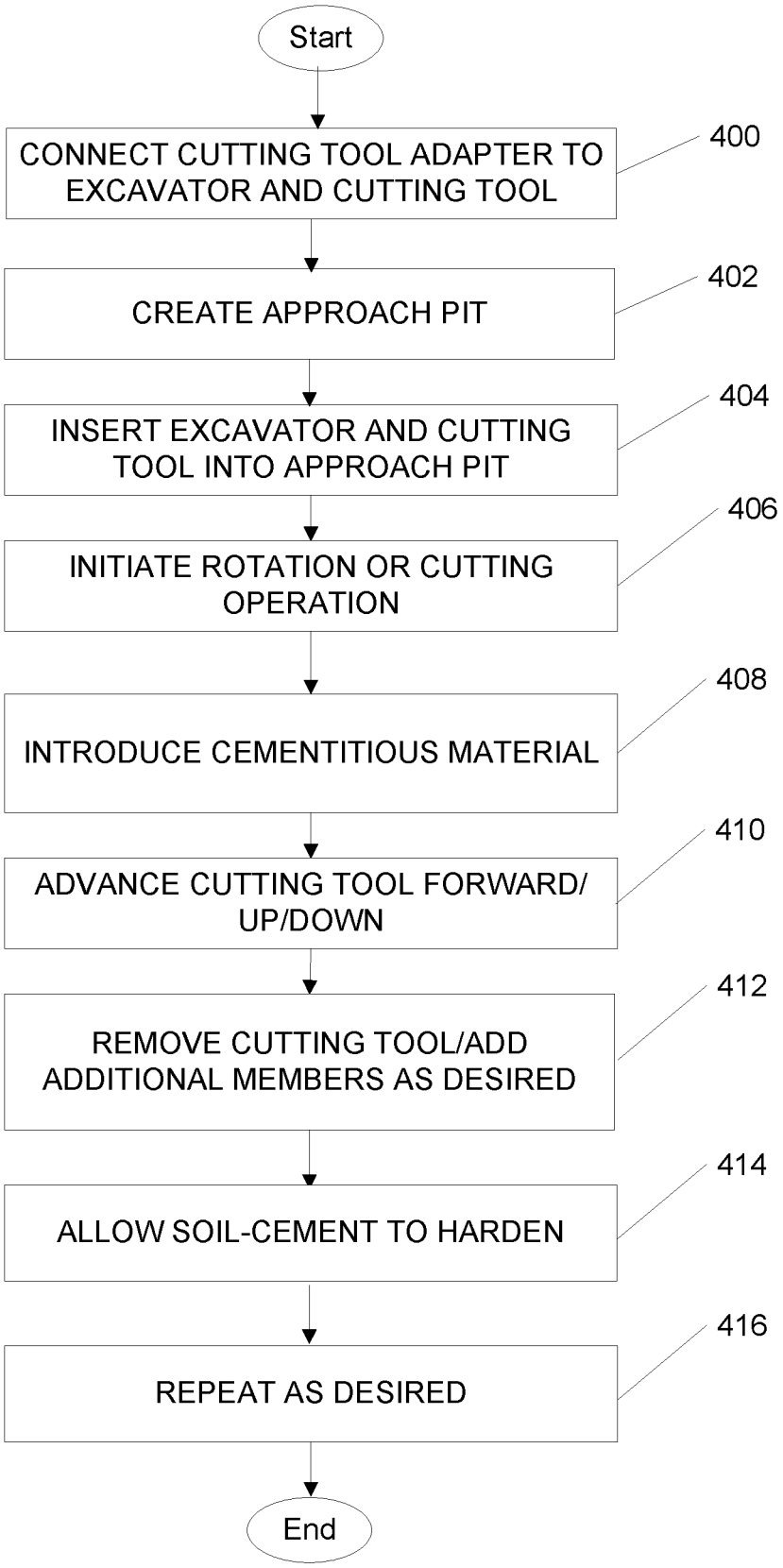
FIG. 4 is a flow chart illustrating one example method of creating an underpinning structure using the cutting tool adapter and other aspects described herein.

FIG. 4 illustrates one example method of creating a soil-cement underpinning structure or element using the cutting tool adapter in accordance with one or more aspects described herein. At step 400, a cutting tool adapter, such as cutting tool adapter 100 shown in FIGS. 1A-1D, cutting tool adapter 500 in FIG. 5, cutting tool adapter 600 in FIGS. 6A-6D, may be used to connect a cutting tool to a working machine. The working machine may be any suitable type of machine having sufficient weight, stability, horsepower, hydraulic oil flow and pressure, arm length, and/or arm range of motion to operate the attached cutting tool 210. In some examples, an additional machine may be used along with the working machine to provide additional hydraulic oil flow to the cutting tool. In some examples, the cutting tool, such as cutting tool 210, may be a transverse or axial cutting tool configured with rotating drums or shafts to enable the eroding and mixing of soil from an area. Various other types of cutting and mixing tools may be used without departing from the invention.

The cutting tool 210 may be connected to the working machine arm 208 via the cutting tool adapter, such as adapters 100, 500, 600. In some examples, one or more fasteners, such as screws, bolts, and the like, may be used to connect the cutting tool to the cutting tool adapter and/or to connect the cutting tool adapter to the working machine arm.

At step 402, an approach pit may be created. For instance, the cutting tool connected to the working machine (or, in some examples, an alternate cutting tool and/or an alternate machine) may be used to remove a portion of soil adjacent (e.g., immediately next to) and below the existing structure or foundation such that an empty approach pit is created. In some examples, the approach pit may be between two (2) and six (6) feet wide, and may extend between one (1) and 10 feet deep below the bottom of the structure or foundation. In some examples, it may not be possible to excavate an empty approach pit. In such cases, as discussed above, the cutting tool may be used to cut and dislodge the soil in the approach pit area while cementitious grout is introduced to the area, thereby creating a fluid or semi-fluid soil-cement mixture within the approach pit (e.g., without first digging the approach pit).

At step 404, the cutting tool 210 may be inserted into the approach pit (or remain there in examples in which the cutting tool is used to create the approach pit). In some examples, inserting the cutting tool into the approach pit may include positioning the cutting tool such that the cutting tool is positioned in a horizontal or substantially horizontal position. Accordingly, in some examples, the cutting tool may be advanced in a general horizontal position and then may be adjusted as desired (e.g., upward or downward). In other examples, the cutting tool may be positioned above or below a horizontal plane and then may be adjusted to move the cutting tool to a substantially horizontal position or to another desired position.

At step 406, rotation of the cutter drums or shafts of the cutting tool or other cutting operation may be initiated. For instance, power may be introduced to the cutting tool to initiate rotation of the cutter drums or shafts and, accordingly, cutting and dislodging of soil from an area adjacent the approach pit and below the existing foundation or structure.

At step 408, cementitious grout or other material may be introduced into an area in which the cutting tool is operating. In some examples, steps 408 and 406 may be performed simultaneously such that a cutting tool rotates to cut and dislodge soil while the cementitious material is introduced to mix the soil and cementitious material.

As discussed herein, cementitious material may be introduced to the area as a slurry via a line or tube (e.g., additive addition line 212). In some examples, the slurry may be pumped at low pressures through an open-ended pipe or tube. In other examples, the slurry may be pumped at high pressures through one or more nozzles. As discussed above, FIGS. 7A and 7B illustrate example arrangements. The cementitious slurry may also be introduced via direct placement into the mixing area. Any suitable cementitious material may be used. For example, Portland cement, slag cement, fly ash, and/or silica fume may be used. Mechanical mixing of the soil and cementitious material may be performed in order to create a soil-cement material. In some examples, the cementitious material may be a cementitious slurry. In other examples, the cementitious material may be a dry powder. In some examples, water may be added to the area to facilitate mixing of the soil-cement and to achieve the desired fluid properties of the soil-cement mixture. In some examples, chemical grout may be used in lieu of cementitious material. For example, chemical grouts such as sodium silicate, acrylates, urethane, epoxy and polyester may be used in lieu of cementitious material.

In some examples, air-entraining admixtures may be added to the cement grout to provide freeze-thaw resistance to the soil-cement element. Additionally or alternatively, non-cementitious slurry, such as bentonite slurry and/or polymer slurry, may be mixed with the soil and the fluid soil-slurry mixture is later displaced using tremie concrete or cement grout, thereby forming an underpinning element of suitable strength and size.

In some arrangements, rapid hardening cement, chemical additives and/or thermal energy may be incorporated into the soil-cement element to achieve high early strength gain and enable the soil-cement element to support foundation loads sooner than is possible with, for example, Type 1 cement.

At step 410, the cutting tool may be advanced forward (e.g., further under the existing structure or foundation), upward (e.g., toward a bottom of the existing structure or foundation) and/or downward (e.g., to a further depth below the existing structure or foundation). As the cutting tool is advanced, additional additive (e.g., cementitious material) is introduced and mixed with the soil to generate a fluid soil-cement which may allow the cutting tool to advance and penetrate more freely or easily. Further, the fluid soil-cement may exert hydrostatic pressure against the sides and/or bottom of the excavation area (e.g., area below the existing structure 202 in which excavation and mixing is occurring) which may aid in stabilizing and supporting adjacent soil from collapsing into the excavation area.

In some examples, the cutting tool may be used to remove and/or mix soil up to a portion of soil in contact with the existing structure or foundation (e.g., to a bottom surface of the existing structure or foundation). Accordingly, the soil-cement mixture creating by mechanically mixing soil and additive (e.g., cementitious material) may be formed up to and in contact with the bottom surface of the existing structure or foundation. In other examples, a gap may be left between the soil-cement material created and the bottom surface of the existing structure or foundation. In those examples, the gap may be subsequently filled with a material or member suitable for transferring the foundation load to the soil-cement element created. Some examples of suitable material for filling the gap may include moist mixtures of sand and cement (drypack), mortar, concrete, or soil-cement, although other materials may be used without departing from the invention. Some examples of suitable members may include steel plates, shims, or structural shapes.

At step 412, the cutting tool may be removed from the underpinned area and approach pit. In some examples, removal of the cutting tool may include inserting one or more additional devices, members, or the like.

For example, a partitioning device, such as partitioning device 250 in FIG. 2H, may be inserted into the fluid soil-cement (e.g., below the existing structure or foundation, along an outside edge of an existing structure or foundation, or the like) to exclude portions of the soil-cement mixture that extend beyond (e.g., in a generally horizontal direction) the portion of the existing structure or foundation requiring support.

In still other examples, one or more reinforcing members, such as reinforcing member 220 in FIG. 2G, may be inserted into the fluid soil-cement to provide additional load carrying capacity to the soil-cement element or structure. In some examples, the reinforcing members, or portions thereof, such as portion 222 in FIG. 2G, may be extended below the bottom of the soil-cement element to develop additional load carrying capacity.

At step 414, the fluid soil-cement created during the mixing process may be allowed to harden. The hardened soil-cement element may then create a durable underpinning for the existing structure that provides sufficient load support (e.g., use of concrete is not necessary).

In some arrangements, as discussed above, one or more support members, such as support member 230 in FIG. 2I, may be installed through the hardened soil-cement to provide additional horizontal and/or vertical support.

At step 416, the process may be repeated as desired. For instance, additional soil-cement underpinning elements may be created under the same or other existing structures or foundations. In some examples, after the soil-cement element has hardened (e.g., is installed beneath the existing structure or foundation), the soil-cement underpinning element may itself be underpinned using the process described herein, or one or more other types of underpinning processes.

Figure 5:
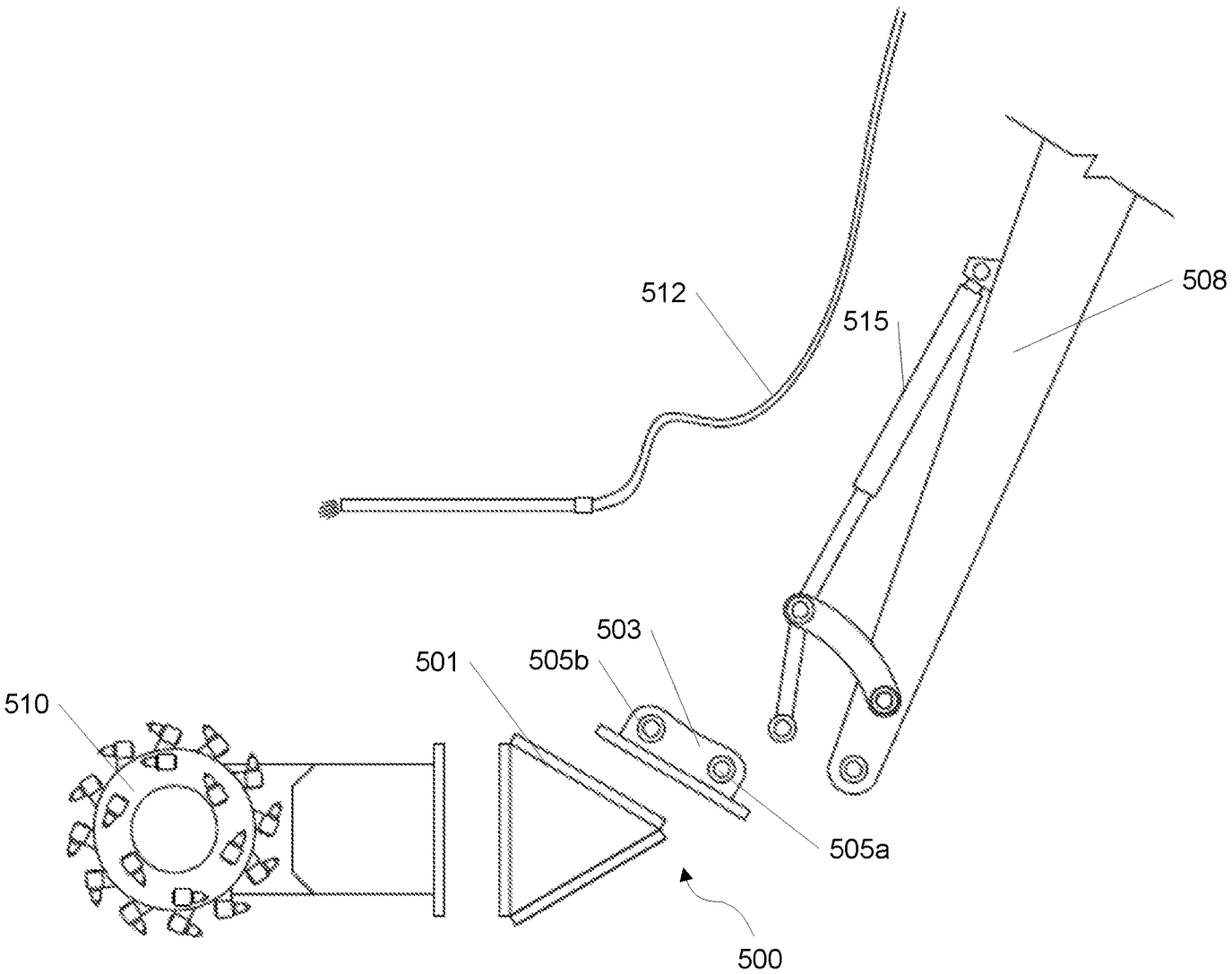
FIG. 5 is an exploded view of another example cutting tool adapter and associated working machine arm and cutting tool in accordance with one or more aspects described herein.

FIG. 5 illustrates one example exploded view of an alternate cutting tool adapter 500. Similar to other arrangements discussed herein, the arrangement of FIG. 5 includes a working machine arm 508, an additive additional line 512, and a cutting tool 510. The cutting tool adapter 500 includes a first portion 501 and a second portion 503. In some examples, the first portion 501 and the second portion 503 may be formed separately and joined together using fasteners such as screws, bolts, and the like. In other examples, first portion 501 and second portion 503 may be formed as a single piece.

The first portion 501 of the cutting tool adapter 500 may be generally triangular in shape. In some examples, the first portion 501 may be an equilateral triangle having three equal sides. The first portion 501 may be formed of steel, iron, or other material suitable for connecting the cutting tool 510 to the second portion 503 of the cutting tool adapter 500.

The second portion 503 of the cutting tool adapter may include two pin locations 505*a* and 505*b*. Similar to arrangements discussed above, the working machine arm 508 may connect to a first pin location 505*a* via a connecting pin (e.g., similar to the first connecting pin arrangement described with respect to FIGS. 1A-1D). The hydraulic cylinder 515 may connect to the second pin location 505*b*. While the first connecting pin 505*a* may be fixed and may provide a point about which the cutting tool 510 may rotate, the second connecting pin 505*b* may be connected to the hydraulic cylinder 515 and, as the hydraulic cylinder is extended or retracted, may cause the cutting tool 510 to rotate relative to the working machine arm 508, similar to rotation arrangements described above.

The second portion 503 may be formed of steel, iron, or other material suitable for connecting the first portion 501 to the working machine arm 508. Accordingly, when the working machine arm 508 is connected to the second portion 503 which is connected to the first portion 501 and the cutting tool 510, the cutting tool can be rotated relative to the working machine arm 508 to enable cutting at various angles, similar to the arrangements described above.

FIGS. 6A-6D illustrate another example cutting tool adapter arrangement. As shown in FIGS. 6A-6D, the cutting tool adapter includes a base plate 604. The base plate may include a first adapter arm 602*a* and a second adapter arm 602*b*. In some examples, the first adapter arm 602*a* and second adapter arm 602*b* may be formed as part of the base plate (e.g., as a single piece). In other examples, the first adapter arm 602*a* and second adapter arm 602*b* may be connected to the base plate 604 using one or more fasteners, welding operations, or the like. In some examples, when connected to the base plate 604, the first adapter arm 602*a* and second adapter arm 602*b* may extend parallel or substantially parallel to each other. Each adapter arm 602*a*, 602*b* may have two opposite generally planar surfaces connected by two side surfaces.

The first adapter arm 602*a* may include an upper aperture 612*a* and a lower aperture 614*a*. The second adapter arm 602*b* may include an upper aperture 612*b* and a lower aperture 614*b*. The upper apertures 612*a* and 612*b*, and the lower apertures 614*a* and 614*b* may be generally aligned when the first adapter arm 602*a* and second adapter arm 602*b* are connected to the base plate 604.

Figure 6A:
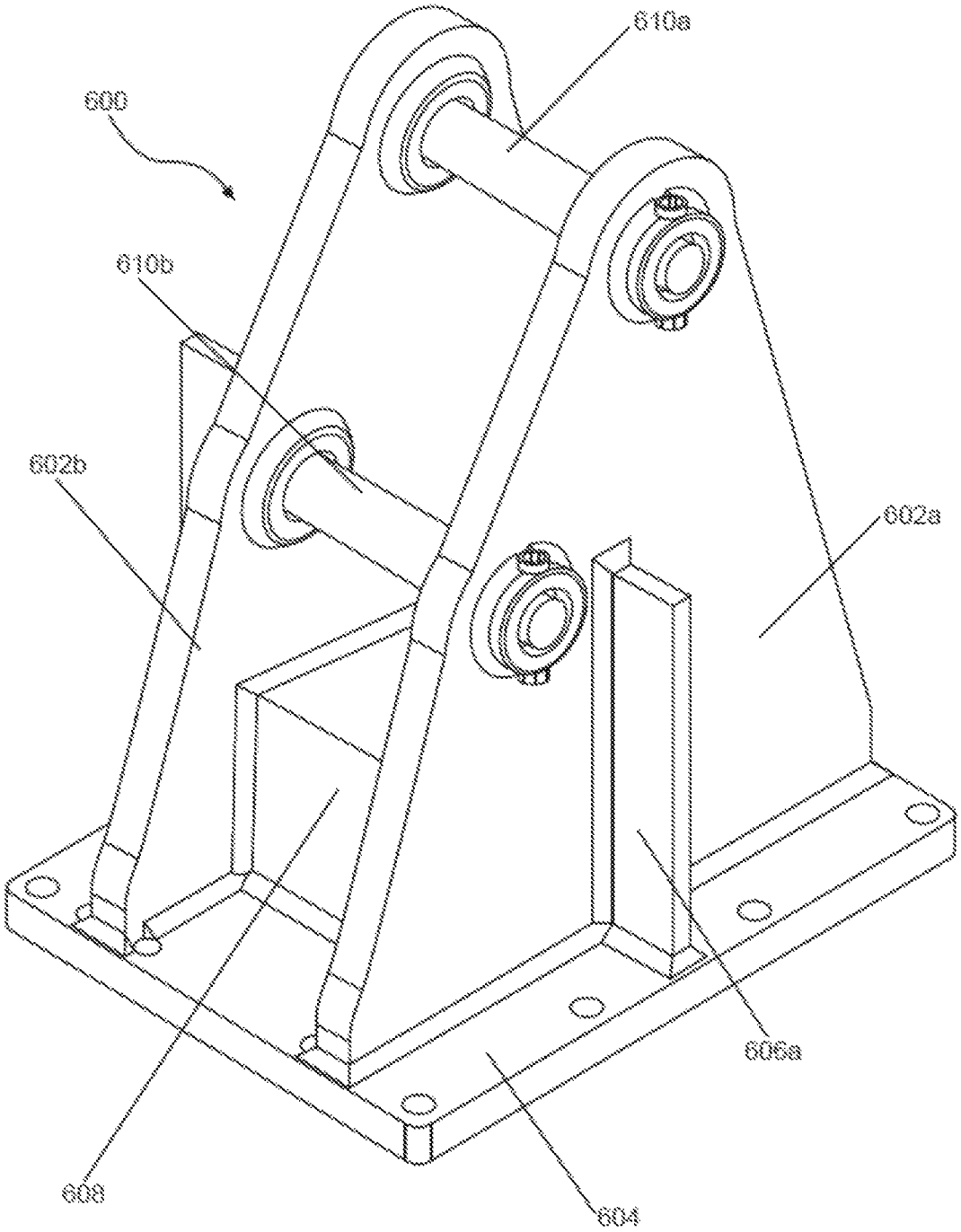
FIGS. 6A-6D illustrate another example cutting tool adapter according to one or more aspects described herein.
Figure 6B:
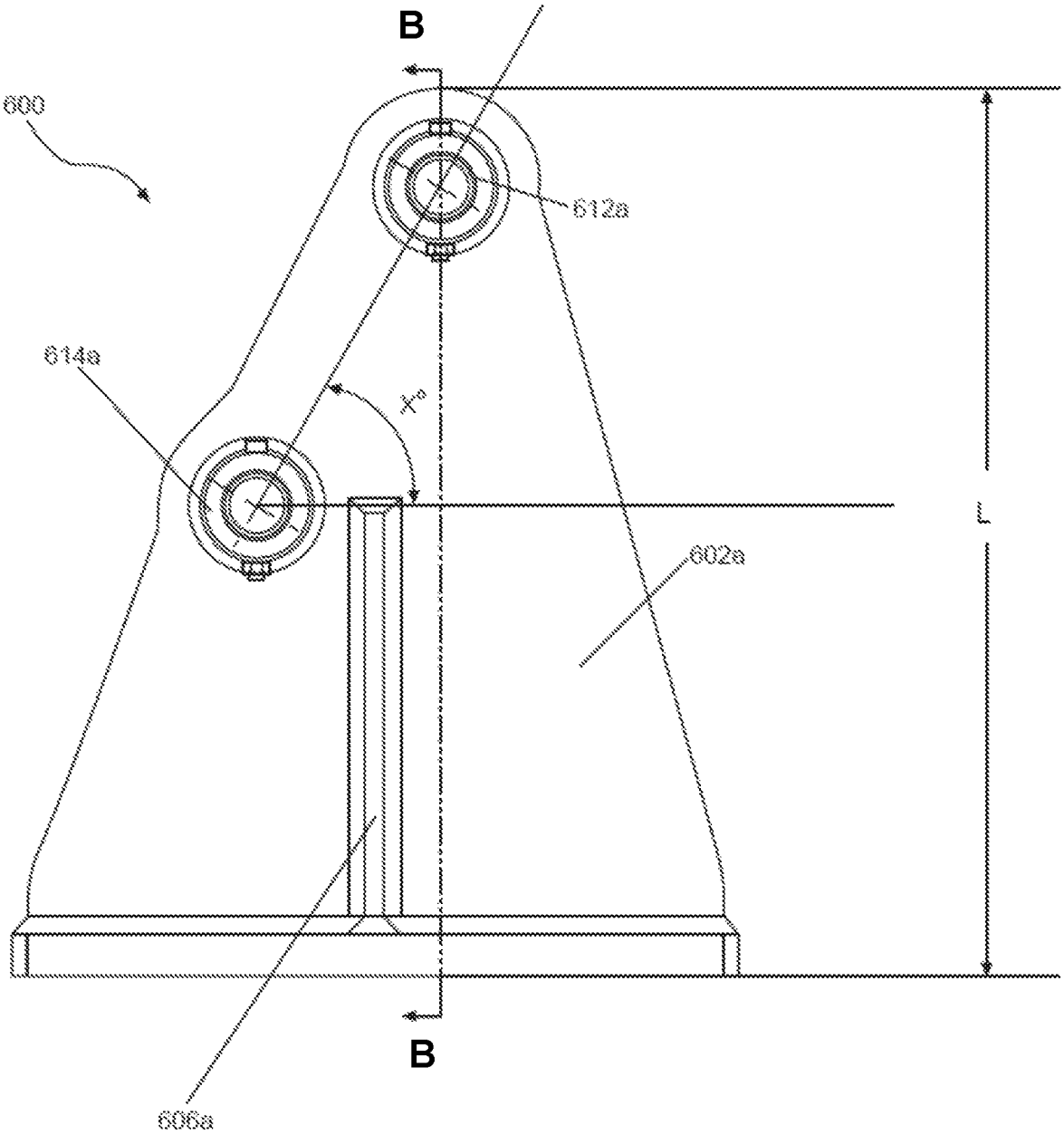

The cutting tool adapter 600 may further include a first connecting pin 610*a* and a second connecting pin 610*b*. The first connecting pin 610*a* may connect the first adapter arm 602*a* to the second adapter arm 602*b* by extending through upper aperture 612*a* and upper aperture 612*b*. The cutting tool adapter 600 may further include a second connecting pin 610*b*. The second connecting pin 610*b* may connect first adapter arm 602*a* to second adapter arm 602*b* by extending through lower aperture 614*a* and lower aperture 614*b*. In some examples, as shown in FIG. 6B, the first connecting pin 610*a* and the second connecting pin 610*b* may form an angle. FIG. 6B illustrates the angle as being X°. In some examples, X may be between 50 and 100 degrees. In other examples, X may be between 55 and 90 degrees. In some example arrangements, X may be a 60 degree angle. In some examples, an angle of 60 degrees may enable a hydraulic cylinder to rotate the attached cutting tool sufficiently to permit the cutting tool to extend upward, downward, and/or to contact the bottom surface of an existing structure, which might not be possible with some (e.g., smaller) angles.

Each connecting pin 610*a*, 610*b* may be secured using one or more fasteners. For instance, FIG. 6D is an exploded view of the cutting tool adapter 600 illustrating some example fasteners that may be used. For instance, the connecting pins 610*a*, 610*b* may be secured using fasteners 616, 618. In some examples, fasteners 616 may be any type of suitable screw. For example, fastener 616 may be a cylinder head cap screw. Fasteners 616 may extend through each connecting pin 610*a*, 610*b* via a flange on an outer surface of each adapter arm 602*a*, 602*b* and surrounding each aperture 612*a*, 612*b*, 614*a*, 614*b*. The fastener 616 may be held in place using fasteners 618 which may be any suitable type of fastener. For example, fasteners 618 may be hex nuts.

In some examples, the first adapter arm 602*a* and second adapter arm 602*b* may further include a support fin to aid in securing the first adapter arm 602*a* and second adapter arm 602*b* to the base plate 604. For instance, a first support fin 606*a* may be generally rectangular and may extend between a side surface of the first adapter arm 602*a* and the base plate 604. A second support fin 606*b* may be generally rectangular and may extend between a side surface of second adapter arm 602*b* and the base plate 604. Each support fin 606*a*, 606*b* may aid in maintaining a position of each of the first adapter arm 602*a* and second adapter arm 602*b*.

In some examples, the first adapter arm 602*a* and second adapter arm 602*b* may further include a support element to aid in securing the first adapter arm 602*a* and second adapter arm 602*b* to the base plate 604 and to each other. For instance, support element 608 may extend between opposing side surfaces of first adapter arm 602*a* and second adapter arm 602*b* and may additionally be secured to base plate 604. Support element 608 may be generally rectangular in some arrangements.

Figure 6C:
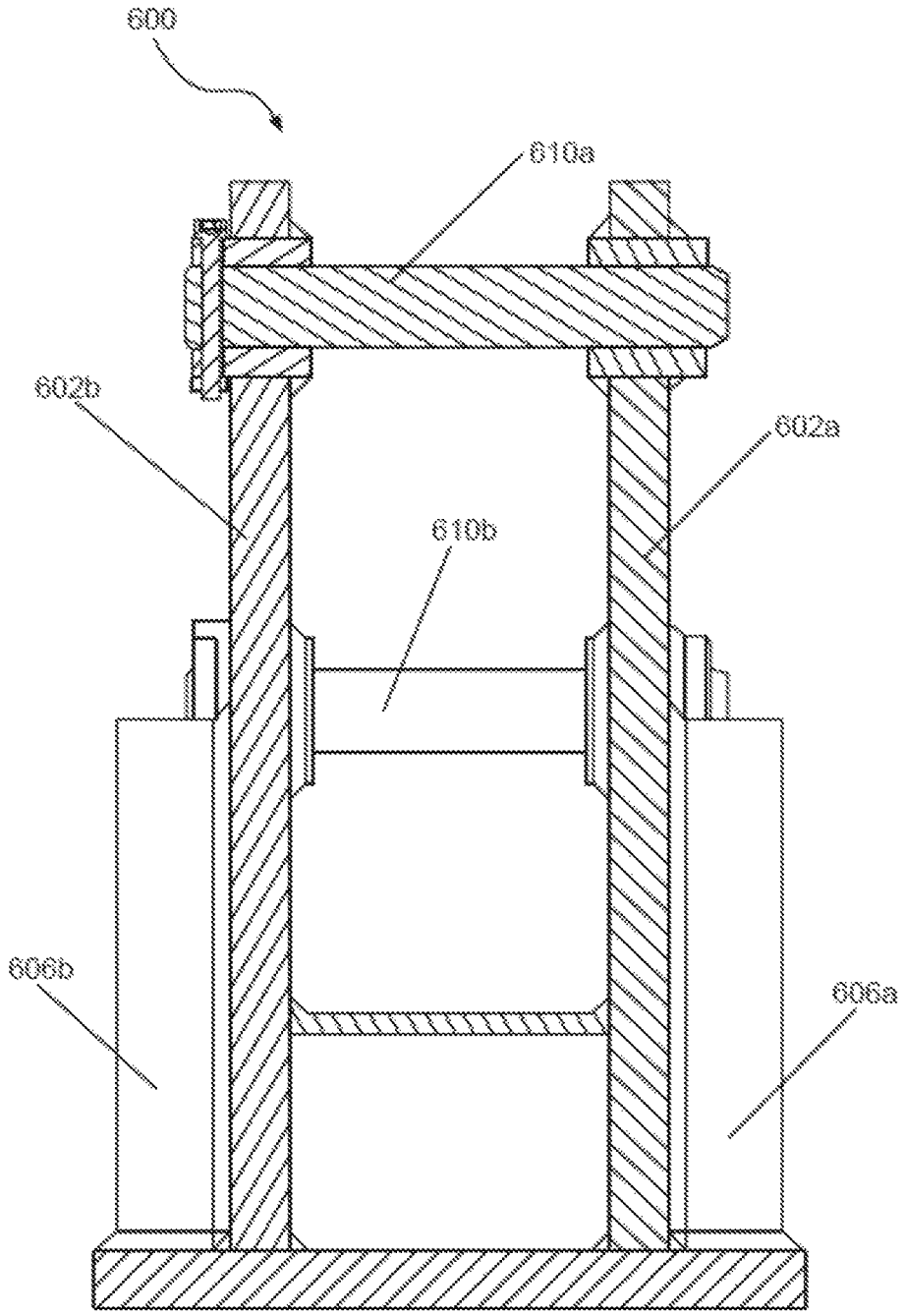
Figure 6D:
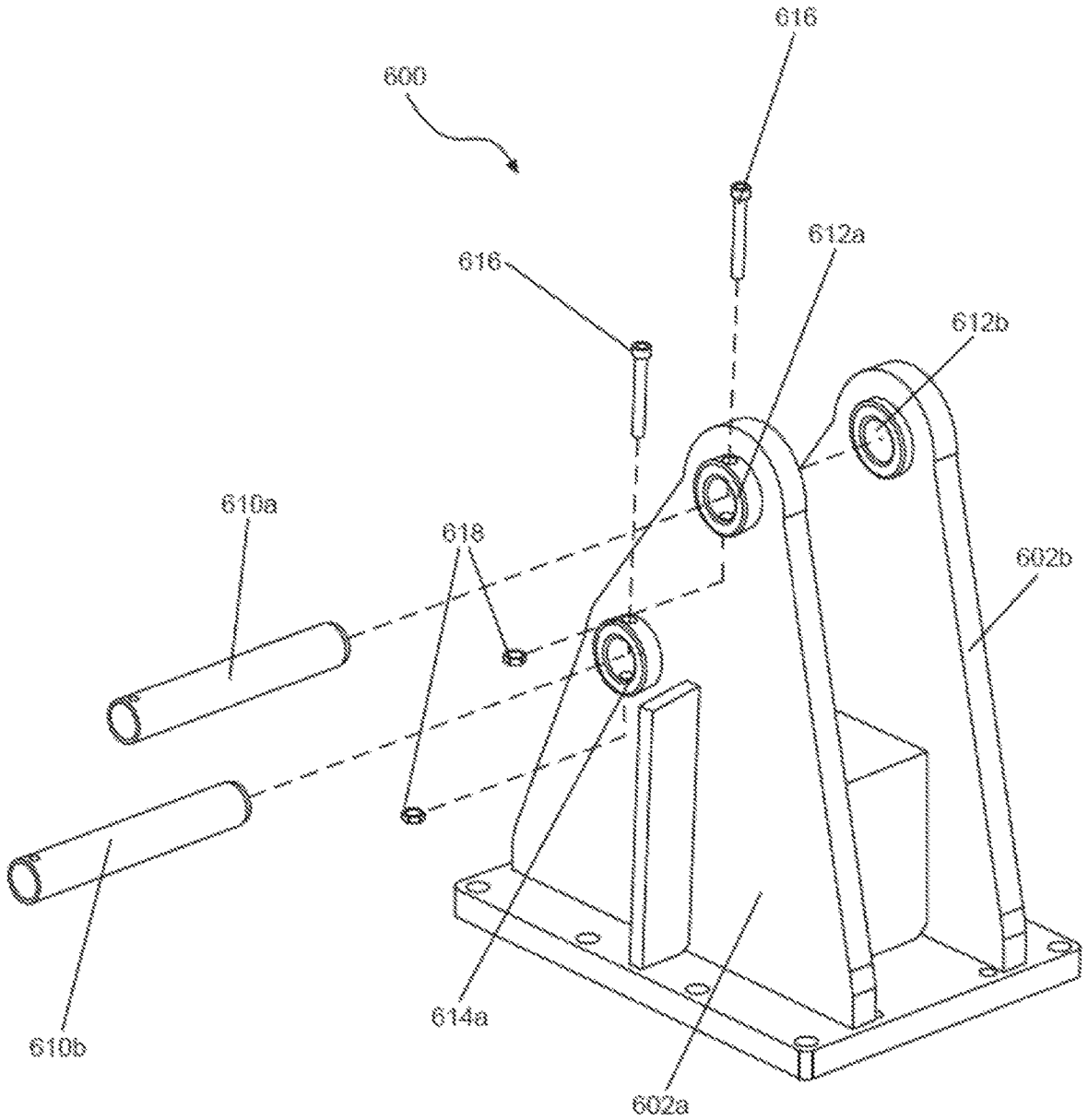

FIG. 6C is a section view of the cutting tool adapter taken along line B-B shown in FIG. 6B. FIG. 6C illustrates connecting pin 610*a* extending between first adapter arm 602*a* and second adapter arm 602*b*. FIG. 6C further illustrates support fins 606*a* and 606*b*.

Similar to cutting tool adapters 100 and 500, cutting tool adapter 600 may be connected to an arm of a working machine, such as an excavator or other earth moving piece of equipment, to enable a cutting tool (e.g. a transverse or axial cutter or mixing tool) to project horizontally, inclined upwards (e.g., with respect to a horizontal plane), or inclined downwards (e.g., with respect to a horizontal plane). In some examples, the cutting tool adapter 600 may be fastened or connected to the working machine arm at two pin locations (e.g., first connecting pin 610*a* and second connecting pin 610*b*). In some examples, one pin location (e.g., first connecting pin 610*a*) may be fixed and serve as an axis of rotation. Another, different pin location (e.g., second connecting pin 610*b*) may be connected to a hydraulic cylinder (e.g., a bucket cylinder). Accordingly, extension or retraction of the hydraulic cylinder may cause the adapter plate to rotate relative to the working machine (e.g., about the first connecting pin 610*a*) and may subsequently cause the cutting tool to rotate relative to the working machine (e.g., an arm of the working machine). Rotation of the cutting tool relative to the working machine may enable positioning of the cutting tool in various locations. A portion of the cutting tool itself may then rotate (e.g. the cutter drum or shaft) to cut and dislodge the earth from below the existing structure or foundation and, in some examples, to contact a bottom surface of the existing structure or foundation. Rotation of the cutting tool thereby enables the cutting tool to cut and dislodge earth from below the existing structure or foundation and, in some examples, to contact a bottom surface of the existing structure or foundation.

The cutting tool adapter 600 may, in some examples, be between 5 inches and 72 inches in length (e.g., dimension L in FIG. 1B). In some arrangements, the cutting tool adapter 600 may be between 8 inches and 32 inches in length (e.g., dimension L in FIG. 1B). In still other examples, the cutting tool adapter 600 may be between 15 inches and 25 inches in length (e.g., dimension L in FIG. 1B). In some examples, this length may enable the cutting tool to extend a desired distance under the existing structure or foundation. The cutting tool adapter 600 may be formed of any suitable material including various metals, composites, or the like.

As discussed herein, the various cutting tool arrangements described enable use of soil-cement mixing to create an underpinning structure having sufficient load bearing strength, while meeting or contacting, in at least some examples, a bottom surface of an existing structure under which the underpinning is being created.

Although the invention has been defined using the appended claims, these claims are illustrative in that the invention may be intended to include the elements and steps described herein in any combination or sub combination. Accordingly, there are any number of alternative combinations for defining the invention, which incorporate one or more elements from the specification, including the description, claims, and drawings, in various combinations or sub combinations. It will be apparent to those skilled in the relevant technology, in light of the present specification, that alternate combinations of aspects of the invention, either alone or in combination with one or more elements or steps defined herein, may be utilized as modifications or alterations of the invention or as part of the invention. It may be intended that the written description of the invention contained herein covers all such modifications and alterations.

We claim:

1. A method of underpinning an existing structure, comprising:

creating an approach pit in an area adjacent to soil below the existing structure;

inserting a mechanical cutting tool into the approach pit, the mechanical cutting tool including at least a drum and plurality of cutting blades attached thereto;

rotating the mechanical cutting tool to a substantially horizontal position, rotating the mechanical cutting tool including rotating the drum and plurality of cutting blades;

cutting and dislodging soil below the existing structure by rotating the drum and plurality of cutting blades relative to a remaining portion of the cutting tool, wherein the cutting and dislodging soil further includes contacting a bottom surface of the existing structure with the cutting tool to remove soil in contact with the bottom surface of the existing structure;

introducing an additive to the soil below the existing structure;

using the mechanical cutting tool, mixing the soil and the additive in an area below the existing structure; and allowing the mixed soil and additive to harden forming an underpinning structure below the existing structure.

2. The method of underpinning an existing structure of claim 1, wherein the cutting tool is one of: a transverse cutting tool and an axial cutting tool.

3. The method of underpinning an existing structure of claim 1, wherein introducing the additive is performed while the cutting and dislodging is performed.

4. The method of underpinning an existing structure of claim 1, wherein the additive is a cementitious material.

5. The method of underpinning an existing structure of claim 4, wherein the cementitious material is a cementitious slurry.

6. The method of underpinning an existing structure of claim 4, wherein the cementitious material is a dry powder.

7. The method of underpinning an existing structure of claim 1, wherein the additive is a chemical grout.

8. The method of underpinning an existing structure of claim 1, further including, prior to allowing the mixed soil and additive to harden forming an underpinning structure below the existing structure, inserting one or more reinforcing members into the mixed additive and soil.

9. The method of underpinning an existing structure of claim 1, wherein the underpinning structure created by the hardened soil and additive mixture is in contact with a bottom surface of the existing structure.

10. The method of claim 1, wherein the cutting tool is connected to an arm of a working machine and rotating the cutting tool includes rotating the cutting tool, including the drum and plurality of blades connected thereto, relative to the arm of the working machine.

11. The method of claim 10, wherein the cutting tool is a transverse cutting tool having an axis of drum rotation transverse to an axis of the arm of the working machine.

12. The method of claim 1, wherein forming an underpinning structure below the existing structure includes forming a single, continuous underpinning structure extending from and in contact with a bottom surface of the existing structure to a depth below the existing structure.

13. The method of claim 12, wherein the single, continuous underpinning structure is formed using a single soil and additive mixing process.

* * * * *